US005655508A

United States Patent [19]

Nonaka

[11] Patent Number: 5,655,508

[45] Date of Patent: Aug. 12, 1997

[54] CYLINDER-DISABLING CONTROL SYSTEM FOR MULTI-CYLINDER ENGINE

[75] Inventor: Kimihiro Nonaka, Hamamatsu, Japan

[73] Assignee: Sanshin Kogyo Kabushiki Kaisha, Hamamatsu, Japan

[21] Appl. No.: 615,785

[22] Filed: Mar. 11, 1996

[30] Foreign Application Priority Data

Mar. 9, 1995 [JP] Japan ..... 7-049587

[51] Int. Cl.[6] ..... F02D 41/00

[52] U.S. Cl. ..... 123/683

[58] Field of Search ..... 123/683, 361, 123/417, 478, 280, 399

[56] References Cited

U.S. PATENT DOCUMENTS 4,166,437 9/1979 Bianchi et al. ..... 123/683

5,558,062 9/1996 De Minco et al. ..... 123/683

*Primary Examiner*—Raymond A. Nelli

*Attorney, Agent, or Firm*—Knobbe, Martens, Olson & Bear LLP

[57] ABSTRACT

A cylinder-disabling control system for a multi-cylinder engine provided with an exhaust manifold to which each exhaust port is connected, which control system comprises: an engine performance sensor; an operation mode selector for selecting the cylinder-disabling mode or the all-cylinders-engaged mode; and a disabled-cylinder designator for designating as disabled at least one of the most upstream cylinder and the exhaust pulse-affected downstream cylinder, when the cylinder-disabling mode is selected, thereby improving driving stability at low rpm's.

14 Claims, 20 Drawing Sheets

Pattern No. 1

Pattern No. 2

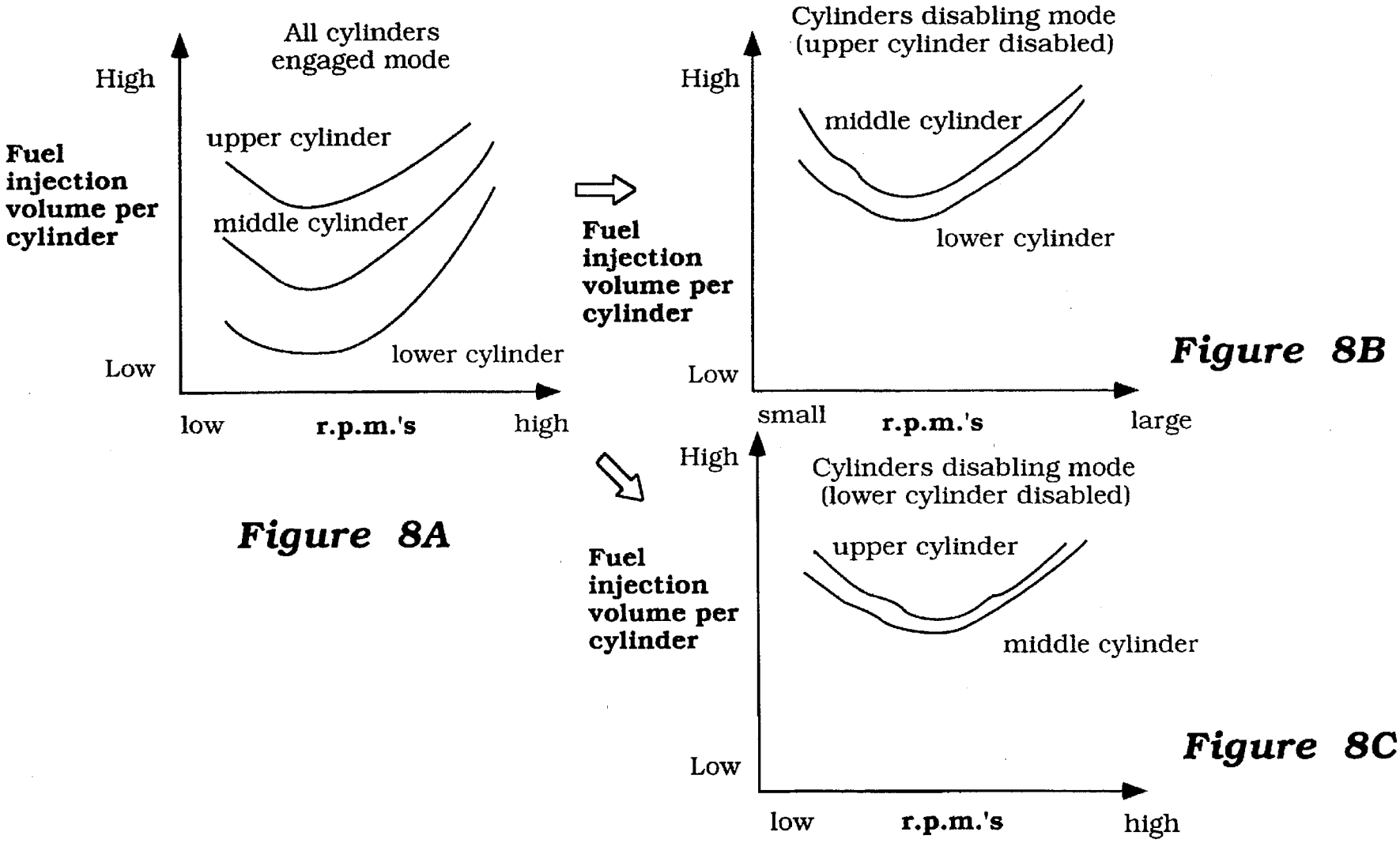
All cylinders engaged mode
upper cylinder
middle cylinder
lower cylinder
Fuel injection volume per cylinder
High
Low
low
r.p.m.'s
high
Figure 8A
Cylinders disabling mode (upper cylinder disabled)
middle cylinder
lower cylinder
Fuel injection volume per cylinder
High
Low
small
r.p.m.'s
large
Figure 8B
Cylinders disabling mode (lower cylinder disabled)
upper cylinder
middle cylinder
Fuel injection volume per cylinder
High
Low
low
r.p.m.'s
high
Figure 8C 4- cylinder operation 6- cylinder operation

CYLINDER-DISABLING CONTROL SYSTEM FOR MULTI-CYLINDER ENGINE

BACKGROUND OF INVENTION

This invention relates to a cylinder-disabling control system for a multi-cylinder engine, especially that of a two-cycle engine, and more particularly to that allowing for continuous and smooth transition between the cylinder-disabling mode and the all-cylinders-engaged mode. This invention also relates to a method therefor.

Engines, especially two-cycle engines, have drawbacks in that scavenging exhaust gas is not efficient when driving at a low speed or with a low load, whereby exhaust gas is not fully expelled, and irregular combustion is likely to occur, leading to unstable engine revolutions.

A method is available for improving unstable engine revolutions. That is, a cylinder-disabling mode, in which at least one but not all of the cylinders are disabled so as to reduce the number of operating cylinders, is employed. By reducing the number of operating cylinders, it is possible to obtain the effects in that exhaust gas pressure (back pressure) in an exhaust system is reduced, and exhaust interference interfering with discharging exhaust gas and introduction of a scavenging stream is inhibited due to transmission of exhaust pulses, leading to an increase in intake volume per cylinder, thereby stabilizing the engine revolutions.

However, particularly for a multi-cylinder engine provided with an exhaust manifold to which each exhaust port is connected, simple disabling-cylinder operation is not sufficient for stabilizing low rpm-driving, and thus, selection of cylinders to be resumed, injection gas volume when resumed, and timing control of ignition must be conducted by taking into consideration the particular characteristics of the multi-cylinder engine with an exhaust manifold.

SUMMARY OF THE INVENTION

The present invention has exploited a cylinder-disabling control system. A principle object of this invention is to provide a cylinder-disabling control system for a multi-cylinder engine, especially with an exhaust manifold, which allows for improvement in stability at low rpm's.

Namely, one important aspect of the present invention is a cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a disabled-cylinder designator for designating as disabled at least one of: the most upstream cylinder, which is a cylinder located most upstream in the direction of exhaust gas flow, and the exhaust pulse-affected downstream cylinder, which is a cylinder receiving exhaust pulse from said most upstream cylinder, when the cylinder-disabling mode is selected. Heretofore, in an engine, especially a two cycle engine, having an exhaust manifold aligned with the cylinders, exhaust gas has been likely to enter the downstream cylinder which receives the above exhaust pulse, because the direction of exhaust pulses from the most upstream cylinder and that of exhaust gas flow are the same. Accordingly, when disabling the middle cylinder while operating the most upstream cylinder and the downstream cylinder receiving the exhaust pulse from the most upstream cylinder in the cylinder-disabling mode, combustion in the cylinder(s) downstream of the most upstream cylinder is destabilized. While in the cylinder-disabling mode, by disabling either one of or both of the most upstream cylinder and the downstream cylinder receiving the exhaust pulse from the most upstream cylinder (the downstream exhaust pulse-affected cylinder), i.e., by preventing simultaneous operation of the most upstream cylinder and the downstream exhaust pulse-affected cylinder, it is possible to improve driving stability at low rpm's. In the above embodiment, it is preferable to install a fuel/air ratio detecting means, as described earlier.

Another important aspect of the present invention is a cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a fuel/air ratio detecting means for detecting the fuel/air ratio in the operating cylinder(s) while in the cylinder-disabling mode. By installing a fuel/air ratio detecting means in the operating cylinder(s) in the cylinder-disabling mode, it is possible to appropriately control the fuel/air ratio even in the cylinder-disabling mode.

Still another important aspect of the present invention is a cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a controller for controlling the fuel injection volume and the ignition timing in the cylinders, said controller including a first control map for setting the fuel injection volume and the ignition timing for each cylinder in the all-cylinders-engaged mode, and a second control map for setting the fuel injection volume and the ignition timing for each cylinder when the cylinder-disabling mode is selected. Heretofore, since the volume of intake air and the gas remaining in the cylinder(s) in the cylinder-disabling mode were changed from those in the all-cylinders-engaged mode by a change in exhaust pressure exerted on each cylinder, it was very difficult to appropriately control combustion in not only the all-cylinders-engaged mode but also the cylinder-disabling mode based on a single control map. By using the first and second maps corresponding to the all-cylinders-engaged mode and the cylinder-disabling mode, respectively, it is possible to appropriately control combustion in not only the all-cylinders-engaged mode but also the cylinder-disabling mode.

In the above embodiment, said second control map is preferably comprised of plural maps corresponding to plural disabling patterns, each map for setting the fuel injection volume and the ignition timing corresponding to each disabling pattern defined by the location of the disabled cylinder(s). By using plural maps corresponding to plural disabling patterns, it is possible to control combustion depending-on each disabling pattern. That is, heretofore, the volume of intake air introduced into the operating cylinder (s) and the volume of fuel remaining in the cylinder(s) were dependent on the disabling pattern, i.e., whether the upstream cylinder(s) are disabled or the downstream cylinder(s) are disabled, whereby the necessary fuel injection volume is changed. By using plural maps corresponding to plural disabling patterns, it is possible to continuously perform the optimum combustion, i.e., respond to a change in the intake air volume and the fuel injection volume, depending on the disabling pattern.

In the above embodiment, said second control map is preferably comprised of a constant-mode map used when the same cylinder is constantly designated as disabled, and a changing-mode map used when different cylinders are designated as disabled. By using the constant map and the changing-mode map, it is possible to appropriately control the fuel injection volume and the ignition timing depending on the disabled cylinder performance, thereby continuously performing the optimum combustion.

In the above embodiment, preferably, said changing-mode map sets the fuel injection volume lower than that set by said constant-mode map, and sets the ignition timing later than that set by said constant-mode map. In the cylinder-disabling mode, when changing the disabled cylinders, fuel is likely to remain in the cylinder(s) while disabled. By using the specific map for constantly engaged cylinder(s) and the specific map for intermittently disabled and engaged cylinder(s), it is possible to reduce the fuel injection volume and delay the ignition timing.

This invention is adapted to be embodied in both an engine control system and an engine management method for an internal combustion engine having a plurality of combustion chambers. This invention is effectively adapted for two-cycle engines and four-cycle engines, especially two-cycle engines since two-cycle engines have particular scavenging characteristics.

BRIEF DESCRIPTION OF THE DRAWINGS

FIG. 1A is a schematic side view, and FIG. 1B is an A—A line cross-sectional schematic view.

FIG. 2A is a schematic cross-sectional view showing cylinders #1–#6 and exhaust pluses, and FIG. 2B is a chart showing the timing of opening and closing of each cylinder.

FIGS. 8A, 8B and 8C are schematic graphs showing the relationship between the fuel injection volume and the engine rpm's with a parameter of cylinders in the cylinder-disabling mode and the all-cylinders-engaged mode of the first embodiment of the present invention; FIG. 8A shows the relationship in the all-cylinders-engaged mode, FIG. 8B shows the relationship in the upper-cylinder-disabling mode, and FIG. 8C shows the relationship in the lower-cylinder-disabling mode.

FIG. 9A shows the relationship in the all-cylinders-engaged mode, FIG. 9B shows the relationship in the upper-cylinder-disabling mode, and FIG. 9C shows the relationship in the lower-cylinder-disabling mode.

FIG. 11A shows the case of four-cylinder operation, FIG. 11B shows the case of five-cylinder operation, and FIG. 11C shows the case of all-cylinder operation.

FIG. 14A shows the case in which the fuel volume introduced into the disabled cylinder was low, and FIG. 14B shows an embodiment of the present invention in which the fuel volume introduced into the disabled cylinder was initially increased and linearly reduced at a certain rate.

DETAILED DESCRIPTION OF THE PREFERRED EMBODIMENTS OF THE INVENTION

Figure 1A:
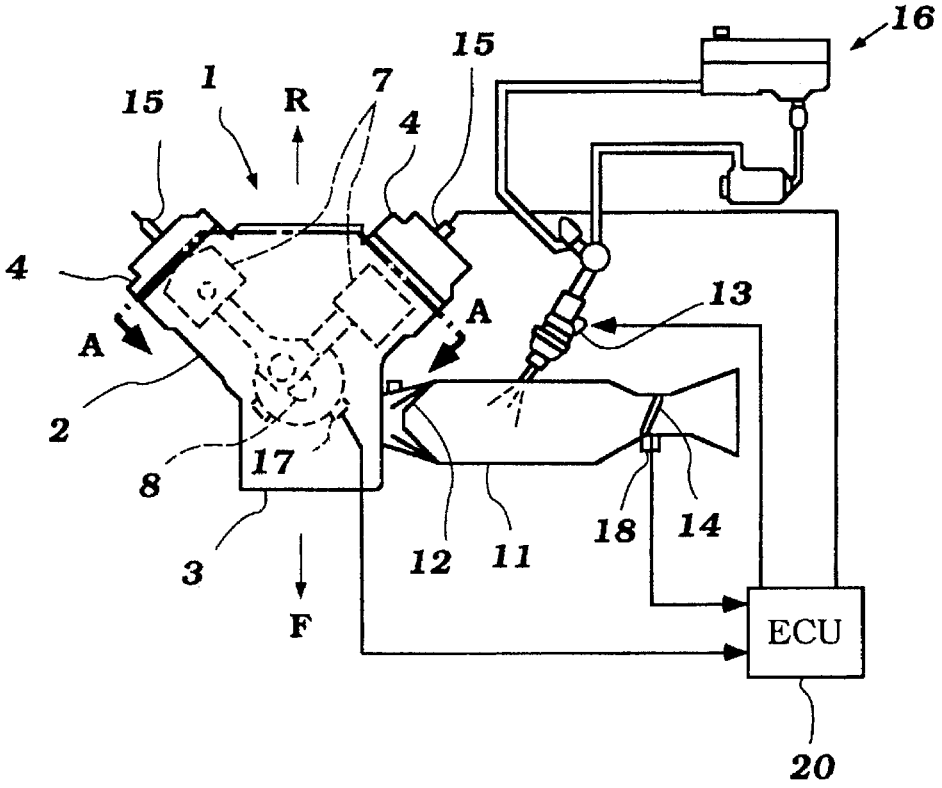
FIGS. 1A and 1B are schematic views showing a cylinder-disabling control system connected to a two-cycle engine in accordance with a first embodiment of the invention.

Referring now in detail to the drawings, and to a first embodiment shown in FIGS. 1–17 initially by reference to FIG. 1, six cylinders of a two-cycle engine are shown in association with the cylinder-disabling control system of the first embodiment of the present invention.

Basic Structures of Exhaust System

Except for a cylinder-disabling control system of the present invention, basic structures of an exhaust system can be constituted based on a conventional system.

In FIG. 1, a reference numeral 1 is a water-cooling type six-cylinder two-cycle V-type outboard engine with a vertical crankshaft. The engine 1 has a structure in which a crankcase 3 is attached to a cylinder block 2 on the front facing the advancing direction of the outboard, and a cylinder head 4 is attached to the cylinder block 2 on the back, which cylinder block has six cylinders (#–#6) on two banks (three cylinders on each bank), and a piston 7 is inserted in each cylinder, each piston being connected to a crankshaft 8 with a connecting rod 7*a*. A reference numeral 15 is an ignition plug.

As shown in an A—A line cross-sectional view of FIG. 1B, cylinders #1, #3, and #5 are aligned vertically in this order on the right bank (hereinafter referred to as "S bank"), and cylinders #2, #4, and #6 are aligned vertically in this order on the left bank (hereinafter referred to as "P bank"), in which cylinders #1, #3, and #5 are in parallel to cylinders #2, #4, and #6. Ignition is conducted in order from #1 to #6 at crank-angle intervals of 60 degrees. Cylinders #1 and #2 are called upper cylinders, cylinders #3 and #4 are called middle cylinders, and cylinders #5 and #6 are called lower cylinders.

Figure 2A:
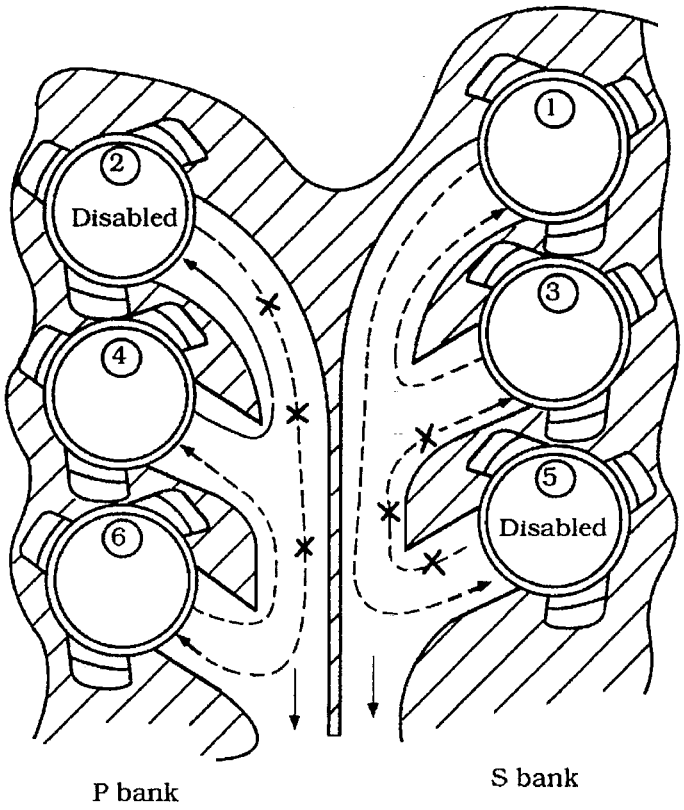
FIGS. 2A and 2B are views showing exhaust pulse interference occurring in cylinders #1–#6 of the first embodiment of the present invention.
Figure 2B:
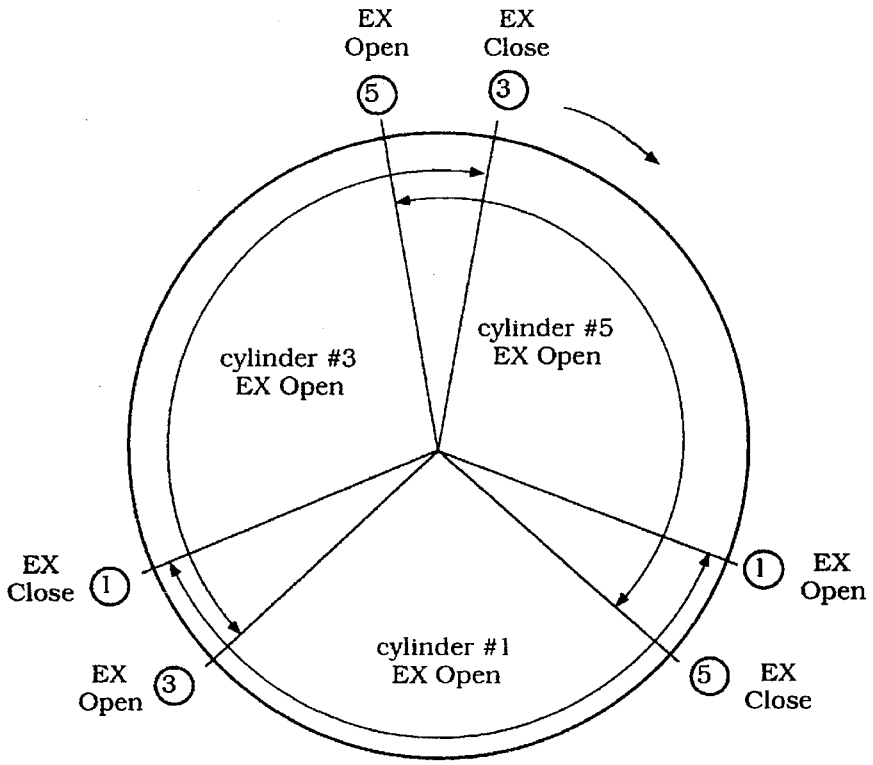
Figure 3:
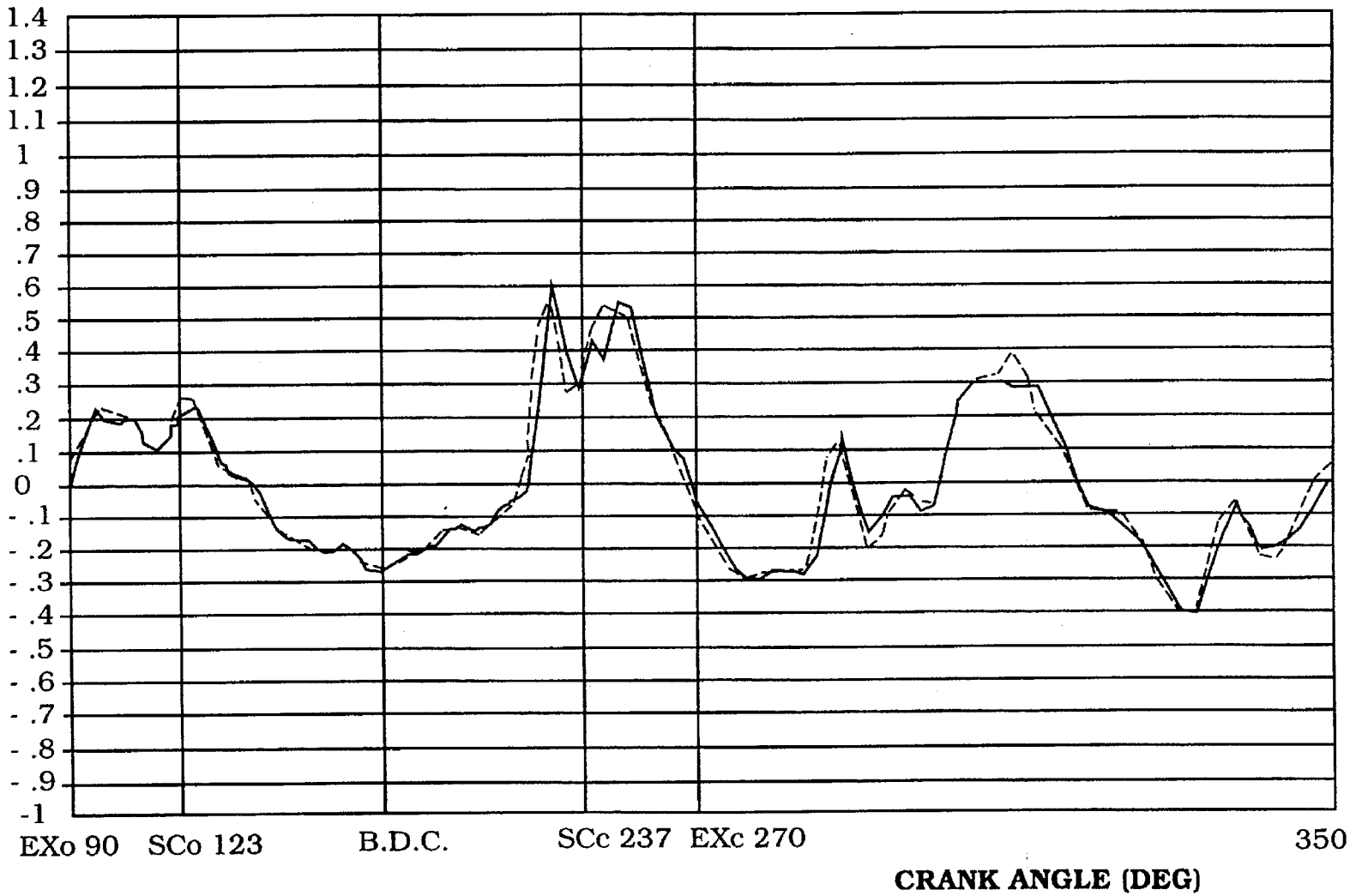
FIG. 3 is a graph showing the relationship between the exhaust pressure and the rotation angle of a crank in the cylinder-disabling control system of the first embodiment of the present invention.

As shown in FIG. 2B, according to the above setting, i.e., 60 degree intervals, the period during which the exhaust port of cylinder #1 is open and the period during which the exhaust port of cylinder #5 is closed are overlapping, and only for the overlapping time period, cylinders #1 and #5 are communicated with each other, thereby exerting intense exhaust pressure from cylinder #1 onto cylinder #5. Since the open period of cylinder #3 and the closed period of cylinder #1 are overlapping, the exhaust pressure from middle cylinder #3 is exerted onto upper cylinder #1. The exhaust pressure from lower cylinder #5 is exerted onto middle cylinder #3 in the same manner. This phenomenon also occurs in the P bank. FIG. 3 is an example showing the relationship between the exhaust pressure and the rotation angle of a crank in the cylinder-disabling control system.

The combustion pressure (i.e., exhaust pressure) is the highest at upper cylinders #1 and #2, and decreases at the middle cylinders (#3 and #4) and at the lower cylinders (#5 and #6) in this order. The reasons for the above are as follows: In order to increase intake air volume and to fully scavenge exhaust gas, taking advantage of exhaust pulses is very effective. For this purpose, relatively long exhaust pipes are required. It is structurally difficult to adopt such long exhaust pipes to all of the cylinders in an engine, especially an outboard engine. However, as understood from FIG. 2A, upper cylinders #1 and #2 are provided with relatively long pipes so that it is possible to take advantage of exhaust pulses efficiently, whereby the intensity of combustion is high, i.e., intense combustion is likely to occur. On the other hand, lower cylinders #5 and #6 do not have long pipes so that sufficient exhaust pulses cannot be generated, and further the direction of exhaust gas flow and that of exhaust pulses from the upper cylinders are the same, thereby decreasing intake volume from the cylinders, i.e., the remaining gas volume increases, leading to that intensity of combustion is weak and intense combustion is not likely to occur.

Accordingly, in this embodiment, cylinders #1 and #2 are the most upstream cylinders while cylinders #5 and #6 are the downstream exhaust pulse-affected cylinders. When upper cylinders #1 and #2 and lower cylinders #5 and #6 are simultaneously subjected to combustion, a large quantity of exhaust gas tends to move into cylinders #5 and #6, resulting in unstable combustion if a cylinder-disabling control system of the present invention described later is not adopted.

Figure 1B:
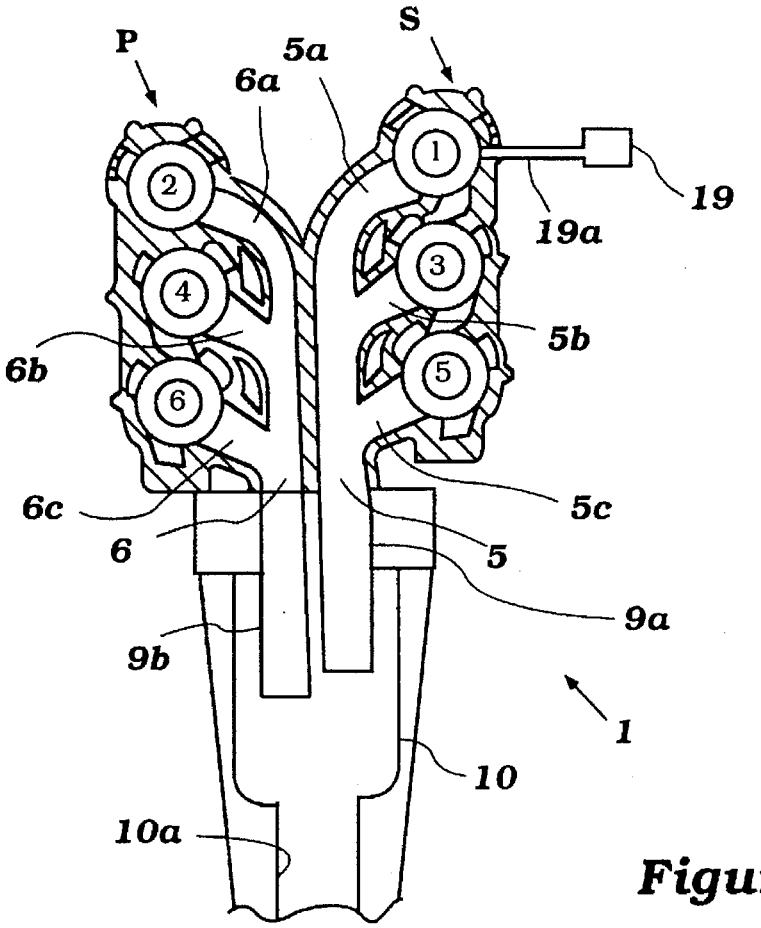

As shown in FIG. 1B, exhaust ports 5*a*, 5*b*, and 5*c* of cylinders #1, #3, and #5, respectively, on the S bank are connected to a right manifold 5 extending in the cylinder alignment direction, and a right exhaust pipe 9*a* connecting the manifold 5 is open in the interior of a muffler 10. Exhaust ports 6*a*, 6*b*, and 6*c* of cylinders #2, #4, and #6, respectively, on the P bank are connected to a left manifold 6 extending in the cylinder alignment direction, and a left exhaust pipe 9*b* connecting the manifold 6 is open in the interior of a muffler 10. Exhaust gas discharged into the muffler 10 is further discharged into water through an exhaust pipe 10*a* via peripheral areas around the driving shaft of a propulsion device.

To each crank room of the crankcase 4, an intake pipe 11 is connected to constitute an independent intake system. Each intake pipe 11 is provided with a check-lead valve 12, a fuel injection valve 13, and throttle valve 14. The reference numeral 16 is a fuel supply system which supplies high-pressure fuel to the fuel injection valve 13 (FIG. 1A).

In addition, the engine 1 of this embodiment is provided with a crank angle sensor 17 for sensing the engine rpm's, a throttle sensor 18 for sensing the opening (load) of the throttle valve 14, and an $O_2$ sensor 19 for sensing the $O_2$ concentration as well as the fuel/air ratio in cylinder #3.

The above $O_2$ sensor 19 is connected to a downstream portion of an exhaust collection outlet 19*a* formed in a position closer to the combustion chamber than the exhaust port 5*a* is, thereby detecting the oxygen concentration of nearly pure burned gas which does not contain blow-by gas, and further detecting the fuel/air ratio of the fuel to the air in a mixed gas introduced into cylinder #1.

Cylinder-Disabling Control System

The engine of this embodiment is equipped with an ECU 20 which controls the ignition timing of engine, the fuel injection volume, the timing of injection, the timing of disabling and operating cylinders, and the like. The ECU 20 has the following functions:

I. An operation mode selector for selecting either a cylinder-disabling mode in which at least one but not all of the cylinders are disabled, or an all-cylinders-engaged mode in which all of the cylinders are operated, depending on the engine performance determined by the engine rpm's and the throttle opening.

II. A designator for designating cylinder(s) as disabled in the cylinder-disabling mode.

III. A fuel injection controller in the all-cylinder-engaged mode.

IV. A fuel injection controller in the cylinder-disabling mode.

V. An ignition timing controller in the all-cylinder-engaged mode.

VI. An ignition timing controller in the cylinder-disabling mode.

VII. A resuming controller for controlling, for example, selection of cylinder(s) to be resumed when resuming operation from the cylinder-disabling mode.

VIII. A fuel injection controller when resuming operation from the cylinder-disabling mode.

IX. An ignition timing controller when resuming operation from the cylinder-disabling mode.

X. A designator for designating constantly-disabled cylinder(s) when resuming operation from the cylinder-disabling mode after the cylinder-disabling mode is released.

In order to control the aforesaid ignition timing and fuel injection volume, the ECU 20 includes a first control map (i.e., all-cylinder operation map) for setting the fuel injection volume and the ignition timing for each cylinder in the all-cylinder-engaged mode, and a second control map (i.e., cylinder-disabling map) for setting the fuel injection volume and the ignition timing for each cylinder when the cylinder-disabling mode is selected.

Figure 4:
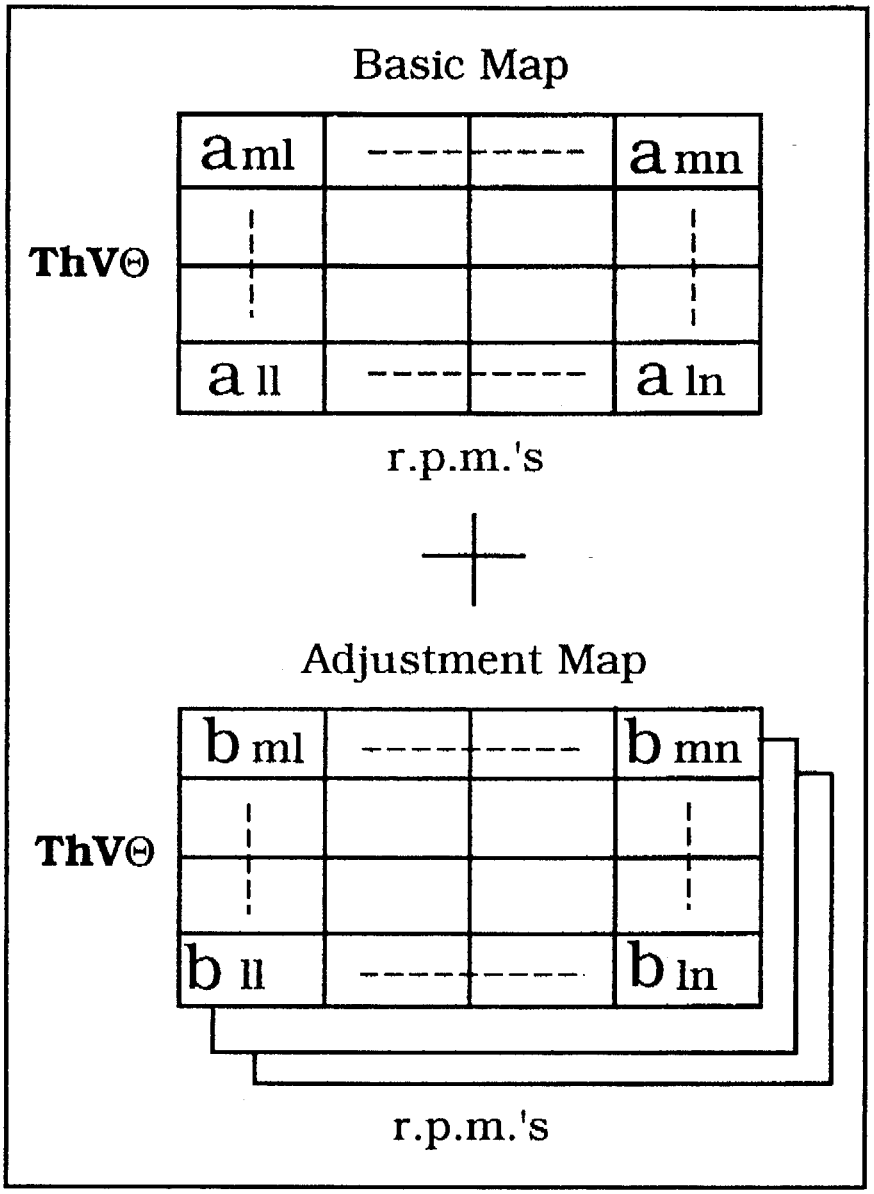
FIG. 4 is a schematic map showing the relationship between the engine rpm's, the throttle angle, and the fuel injection volume in the all-cylinders-engaged mode of the first embodiment of the present invention.

As shown in FIG. 4, the all-cylinder operation map is composed of a basic map for determining the basic fuel injection volume based on the engine rpm's and the throttle opening (THvθ), and an adjusting map for adjusting the above basic fuel injection volume between cylinders depending on intake air volume characteristics of upper, middle, and lower cylinders.

Figure 5:
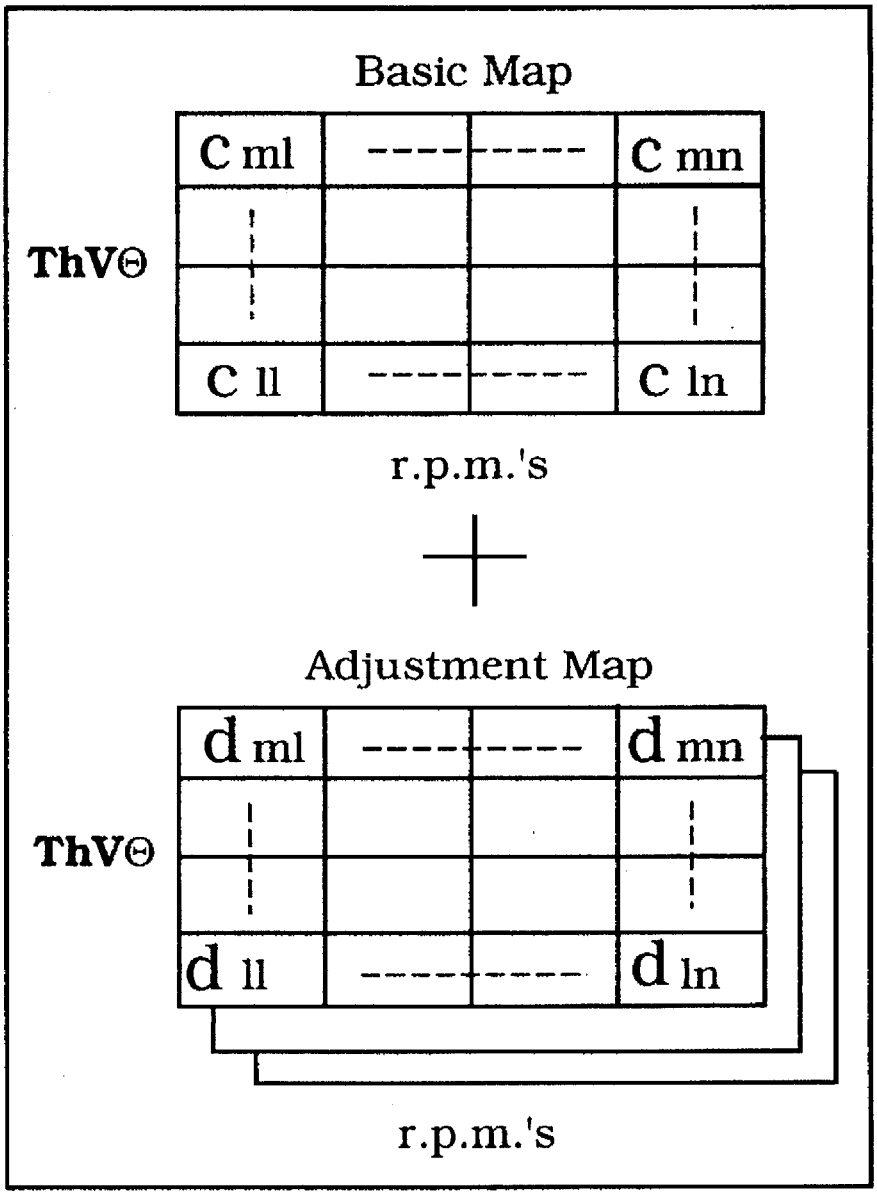
FIG. 5 is a schematic map showing the relationship (Pattern No. 1) between the engine rpm's, the throttle angle, and the fuel injection volume in the cylinder-disabling mode of the first embodiment of the present invention.
Figure 6:
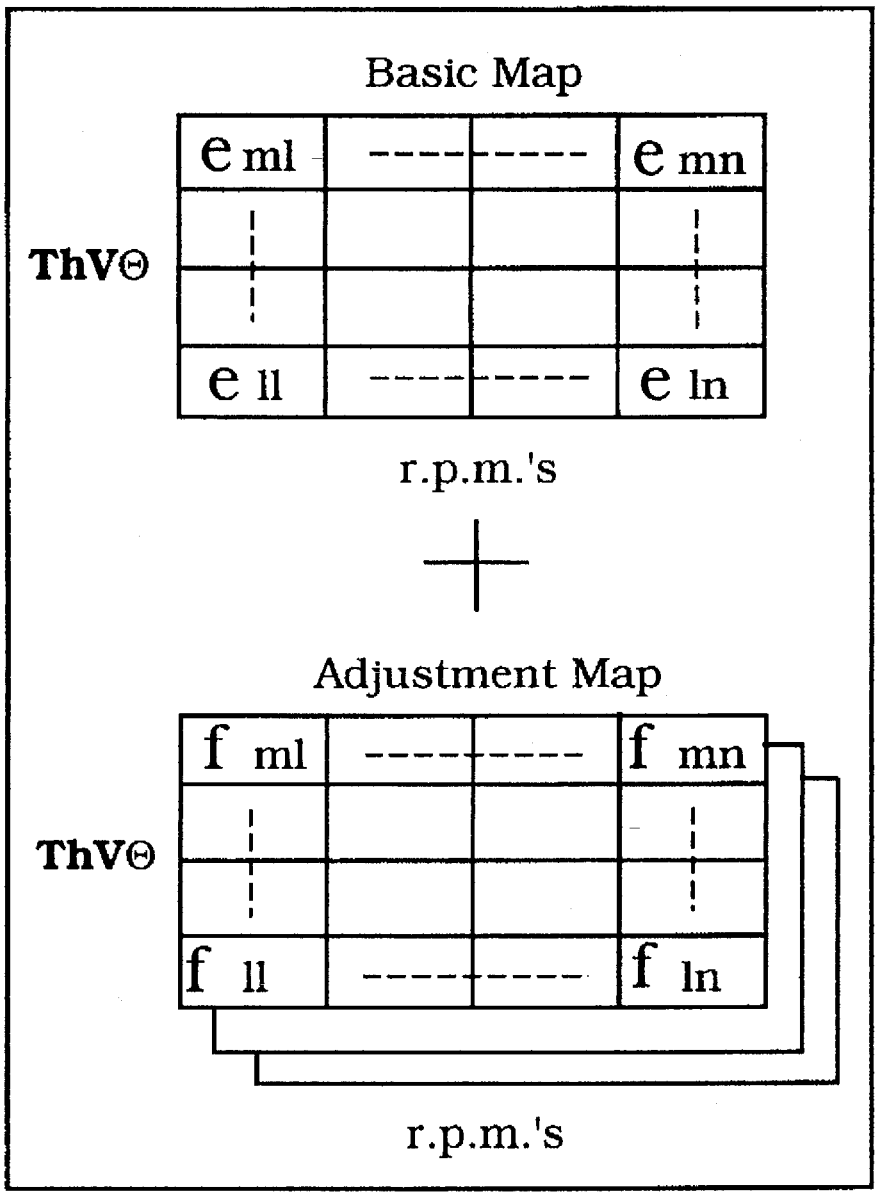
FIG. 6 is a schematic map showing the relationship (Pattern No. 2) between the engine rpm's, the throttle angle, and the fuel injection volume in the cylinder-disabling mode of the first embodiment of the present invention.

As shown in FIGS. 5 and 6, depending on the disabling patterns, the cylinder-disabling map is composed of a pattern No. 1 map (FIG. 5) for the case in which cylinders #1 and #2 are constantly disabled and the remaining cylinders are operated, and a pattern No. 2 map (FIG. 6) for the case in which cylinders #5 and #6 are constantly disabled and the remaining cylinders are operated.

I. Functions as Operation Mode Selector

Figure 7:
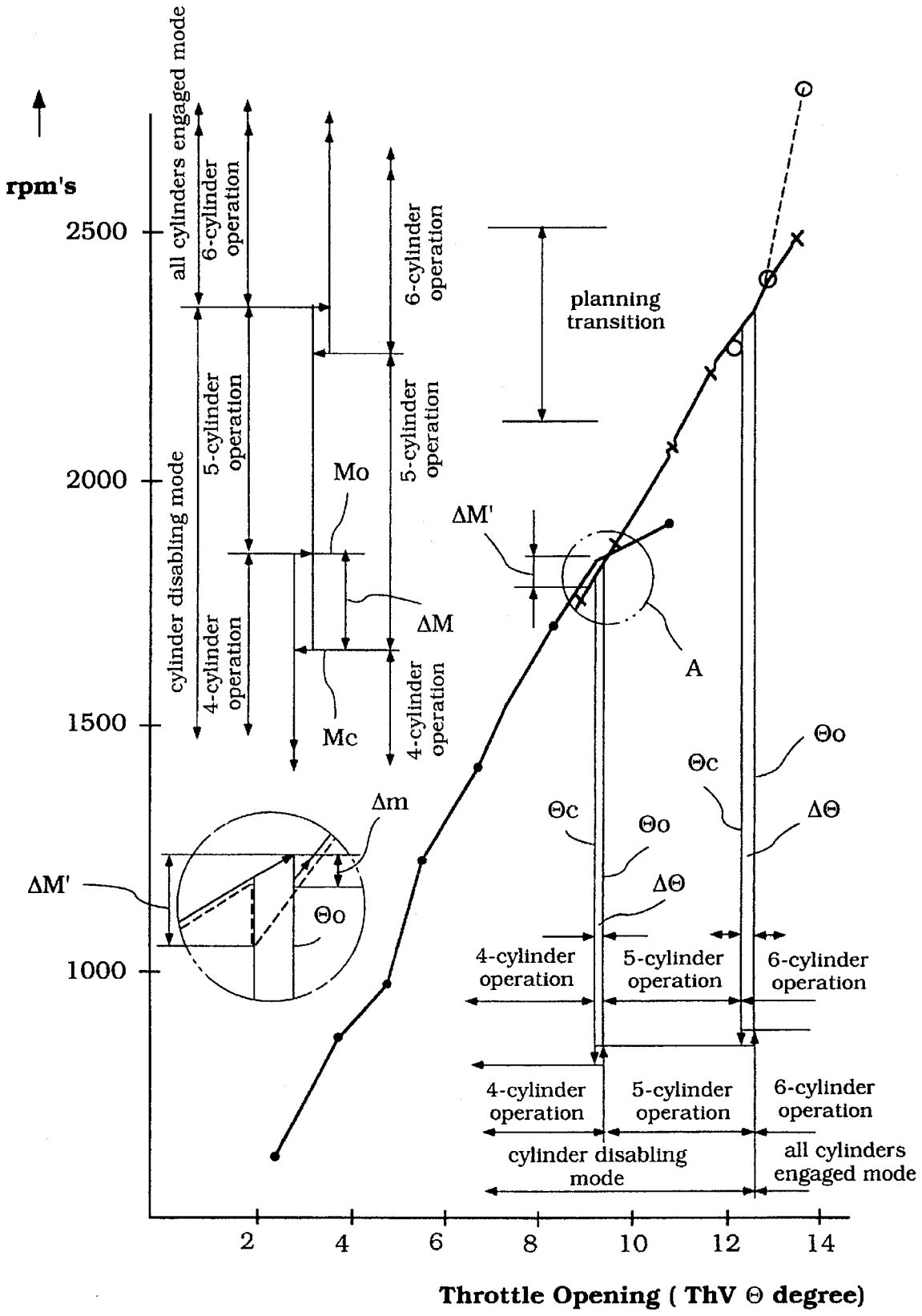
FIG. 7 is a schematic graph showing a control range of the cylinder-disabling control system of the first embodiment of the present invention in connection with the relationship between the throttle opening and the engine rpm's.

As shown in FIG. 7, depending on the throttle opening or the engine rpm's, one operation mode is selected from the cylinder-disabling mode, i.e., four-cylinder operation or five-cylinder operation, or the all-cylinder-engaged mode, i.e., six-cylinder operation. By a selection switch (not shown), either the throttle opening control or the engine revolution control is selected.

Irrespective of whether disabled cylinder(s) are predesignated or designated at a time, cylinder-disabling operation is conducted by ceasing ignition in the cylinder, and fuel supply to the disabled cylinder is continued via the fuel injection valve 13.

When switching the operation mode based on the throttle opening, a certain hysteresis opening $\Delta\theta$ is set between first throttle opening $\theta_c$, i.e., the throttle opening on the closed side when reducing the number of operating cylinder(s), and second throttle opening $\theta_o$, i.e., the throttle opening on the open side when increasing the number of operating cylinders.

When switching the operation mode based on the engine rpm's, a certain hysteresis rpm's, $\Delta M$, is set between first engine rpm's, $M_c$, i.e., the engine rpm's on the reduced side when reducing the number of operating cylinder(s), and second engine rpm's, $M_o$, i.e., the engine rpm's on the increasing side when increasing the number of operating cylinders.

The hysteresis engine rpm's, $\Delta M$, should be greater than engine rpm's, $\Delta M'$, corresponding to the hysteresis opening $\Delta\theta$ for the following reasons: In the case of an outboard engine such as in this embodiment, the engine rpm's widely fluctuate due to impact of waves or the like even when the throttle opening remains the same. Thus, when controlling the above switching operation based on the engine rpm's, if hysteresis rpm's are not sufficiently high, hunting, i.e., frequently changing the number of operating cylinder(s), is likely to occur.

In contrast, when controlling the above switching operation based on the throttle opening, it is possible to prevent hunting even though hysteresis $\Delta\theta$ and further $\Delta M$ are set low. Thus, it is preferable to control the switching based on the throttle opening.

II. Functions as Designator for Disabled Cylinders

Cylinders are designated as disabled in such a way that the phase difference between every two disabled cylinders is constant. In this embodiment, the ignition intervals between every two cylinders next to each other from cylinder #1 through cylinder #6 are 60 degrees, and in order to set a constant phase difference between the disabled cylinders, upper cylinder #2 on the P bank and lower cylinder #5 on the S bank are disabled, for example. Accordingly, every time two cylinders are subjected to ignition, one cylinder is disabled, so that the overall ignition intervals become constant when designating disabled cylinders, thereby balancing the ignition timing, and stabilizing low speed drive.

In addition, disabled cylinders are selected in such a way that, on each bank, the most upstream cylinder and the downstream cylinder which receives influence of exhaust gas and exhaust pulses from the most upstream cylinder do not occur at the same time. In this embodiment, in order to prevent such a simultaneous ignition, uppermost cylinder #2 on the S bank and lower cylinder #5 are disabled. Accordingly, when the most upstream cylinder #1 on the S bank is operated, lower exhaust pulse-affected cylinder #5 is disabled. On the P bank, when lower cylinder #6 is operated, upper cylinder #2 is disabled, thereby preventing simultaneous ignition.

By avoiding simultaneous ignition of the most upstream cylinder and lower cylinder, it is possible to facilitate low speed stability while in the cylinder-disabling mode for the following reasons: FIG. 2 is a view showing exhaust pulse interference occurring in cylinders #1–#6. FIG. 2A is a schematic cross-sectional view showing cylinders #1–#6 and exhaust pluses. Exhaust pulses from upper cylinder #1, middle cylinder #3, and lower cylinder #5 are exerted on lower cylinder #5, upper cylinder #1, and middle cylinder #3, respectively. This is because, as shown in FIG. 2B, the closed periods of the exhaust ports of cylinders #5, #1, and #3, which receive influence, and the open period of the exhaust ports of cylinders #1, #3, and #5, which influence the above respective cylinders, are overlapping. Incidentally, the direction of exhaust gas flow from upper cylinders #1 and #2 and the direction of exhaust pulses are the same, and thus, combustion in lower cylinders #5 and #6 is likely to be disturbed. However, in this embodiment, when lower cylinder #6 is operated, upper cylinder #2 is disabled, and when upper cylinder #1 is operated, lower cylinder #5 is disabled, thereby eliminating influence of exhaust pulses, and improving low speed stability.

III. Functions as Fuel Injection Controller in All-Cylinder-Engaged Mode

The fuel injection control in the all-cylinder-engaged mode is conducted based on the map of FIG. 4 showing the relationship between the engine rpm's, the throttle angle, and the fuel injection volume in the all-cylinders-engaged mode. The fuel injection volume in each cylinder of the upper cylinders, the middle cylinders, and the lower cylinders is in descending order. As described earlier, in the case of an outboard engine, it is structurally difficult to adopt to all of the cylinders exhaust pipes sufficiently long to obtain exhaust pulse effects. However, the upper cylinders are provided with relatively long pipes so that it is possible to take advantage of exhaust pulses efficiently, thereby increasing the intake volume and the fuel injection volume. On the other hand, the lower cylinders do not have long pipes so that sufficient exhaust pulses cannot be generated, and further, the direction of exhaust gas flow and that of exhaust pulses from the upper cylinders are the same, thereby decreasing intake volume from the cylinders and the fuel injection volume.

IV. Functions as Fuel Injection Controller in Cylinder-Disabling Mode

The fuel injection volume control while in the cylinder-disabling mode is conducted based on the fuel injection volume maps for the cylinder-disabling mode, depending on disabling patterns (FIGS. 5 and 6). When upper cylinder #1 or #2 is disabled, the fuel injection volume control is conducted based on the pattern No. 1 of FIG. 5. In this disabling pattern No. 1, as shown in FIG. 8B, the fuel injection volume is significantly increased as a whole, as compared with that in the all-cylinder-engaged mode (FIG. 8A), and further, the difference in the fuel injection volume between the middle cylinder and the lower cylinder is small. This is because the back pressure of the exhaust gas is reduced due to the upper cylinder being disabled, and the intake volume in the lower and middle cylinders is increased to a great extent due to no influence on the lower cylinder, thereby increasing the overall fuel injection volume. In addition, since there is no influence from the upper cylinder, the intake volume of the lower cylinder is as high as that of the middle cylinder, thereby reducing the difference in the fuel injection volume between the lower cylinder and the middle cylinder.

When a lower cylinder is disabled (disabling pattern No. 2), the fuel injection volume control is conducted based on the map of FIG. 6. In this case, as shown in FIG. 8C, as compared with in the all-cylinder-engaged mode, the overall fuel injection volume of the upper cylinder is a little decreased, and that of the middle cylinder is significantly increased. This is because the back pressure of the exhaust gas is reduced due to the lower cylinder being disabled, and there is no influence from the lower cylinder, leading to that the fuel injection volume in the middle cylinder is increased to a great extent, and the fuel injection volume in the upper cylinder is a little decreased due to increasing influence from the middle cylinder, thereby reducing the difference in the fuel injection volume between the upper cylinder and the middle cylinder.

V. Functions as Ignition Timing Controller in All-Cylinder-Engaged Mode

Figures 9A, 9B, 9C:
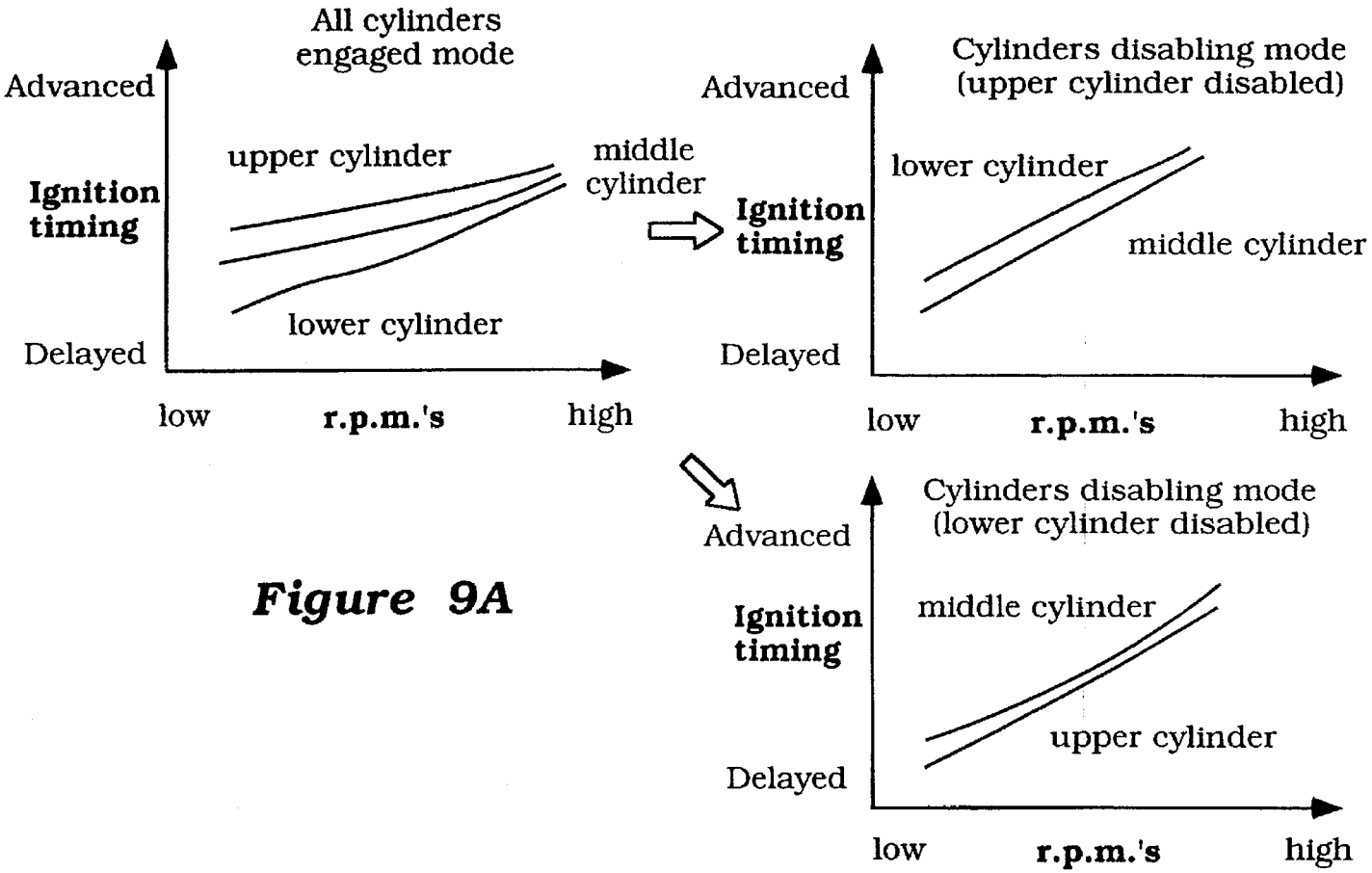
FIGS. 9A, 9B and 9C are schematic graphs showing the relationship between the timing of ignition and the engine rpm's with a parameter of cylinders in the cylinder-disabling mode and the all-cylinders-engaged mode of the first embodiment of the present invention.

In the all-cylinder-engaged mode, as shown in FIG. 9A, advanced timing control is conducted to all of the cylinders in association with an increase in the engine rpm's, similarly as a whole to the conventional engines. However, when focusing each cylinder, the upper the cylinder the greater the delayed timing control is conducted. As described earlier, the upper the cylinder the more the fuel injection volume is increased, and thus, in order to equalize combustion intensity of each cylinder, the more the fuel injection volume the less the angle for advanced timing is employed.

VI. Functions as Ignition Timing Controller in Cylinder-Disabling Mode

In the upper cylinder-disabling mode based on the pattern No. 1, as shown in FIG. 9B, as compared with in the all-cylinder-engaged mode, the ignition timing is set to be delayed in a low speed range and advanced in a middle speed range, thereby suppressing an excess increase in combustion intensity due to a great increase in the fuel injection volume in the low speed range, and compensating for reduced output due to an decrease in the number of operating cylinders in the middle speed range. When focusing each cylinder, the angle for delayed timing is widened because the fuel injection volume of the lower cylinder is further increased, and the difference in the ignition timing between the lower cylinder and the middle cylinder.

In the lower cylinder-disabling mode based on the pattern No. 2, as shown in FIG. 9C, as compared with in the all-cylinder-engaged mode, the angle is low in a low speed range and steady in a middle speed range, thereby widening the angle for delayed timing in the low speed range, especially of the middle cylinder. The reason for the above is to control imbalance of combustion intensity generated by an increase in the fuel injection volume of the middle cylinder.

Figure 10:
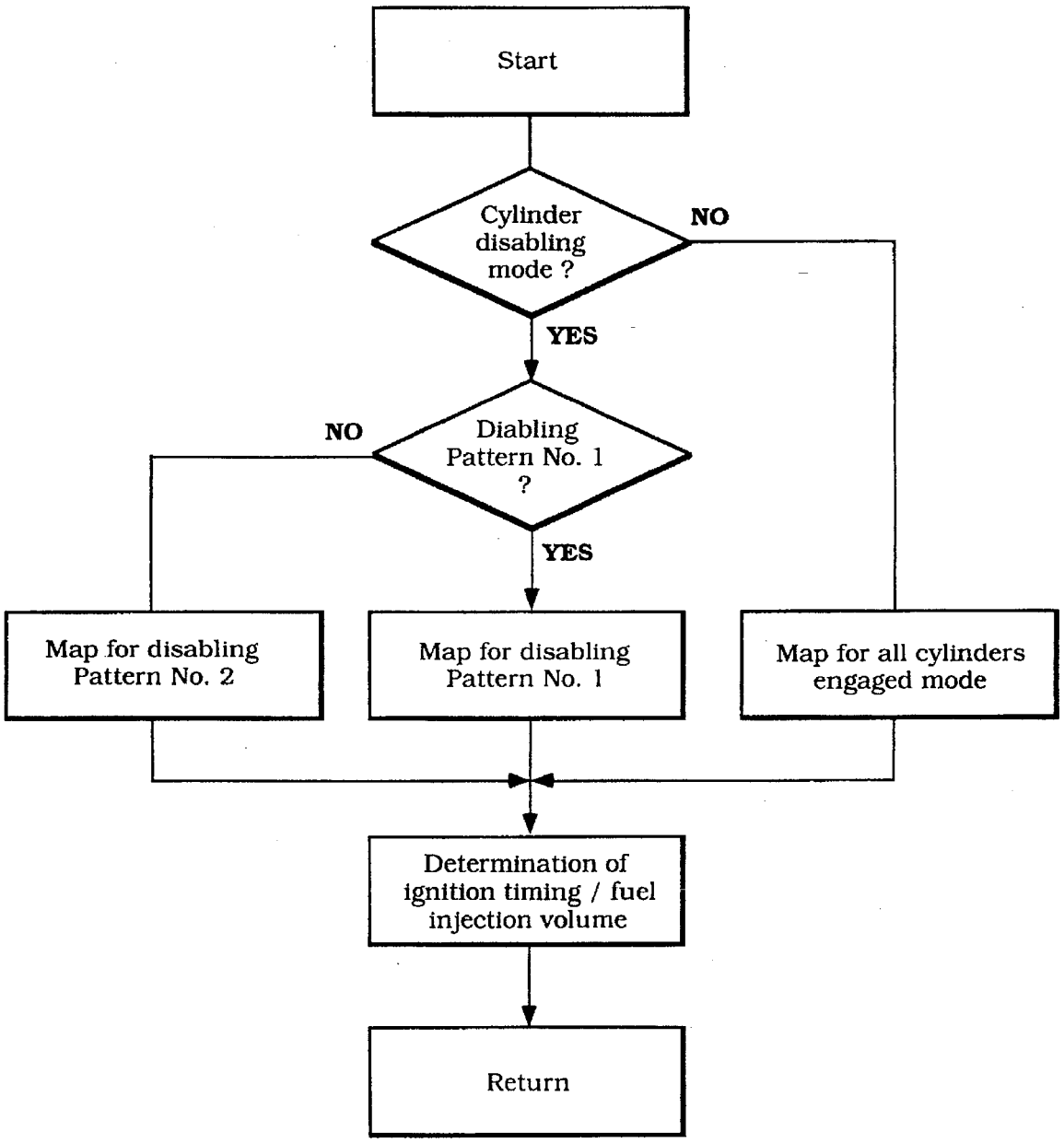
FIG. 10 is a flow chart showing the control flow of the first embodiment of the present invention.

FIG. 10 is a flow chart showing the control flow of the above fuel injection volume and the ignition timing. In step S1, it is determined whether or not the cylinder-disabling mode is selected based on the engine performance, and in step S2, the map for all-cylinder operation is referred to when the mode is not the cylinder-disabling mode. If the mode is the cylinder-disabling mode, it is determined which pattern is selected, disabling pattern No. 1 or No. 2, and in steps S3–S5, the control map for disabling pattern No. 1 or the control map for disabling pattern No. 2 is referred to. In step S6, the most appropriate ignition timing and fuel injection volume are determined.

VII. Functions as Resuming Controller

When the all-cylinder-engaged mode is resumed from the cylinder-disabling mode, (a) the number of operating cylinders is increased one by one, (b) the downstream cylinders which are not likely to undergo intense combustion is resumed precedent to other cylinders, and/or (c) the conditions under which the change induced by a change in the number of operating cylinders is not easily perceived are employed, thereby avoiding deterioration of continuous and smooth transition, due to impact caused when resumed.

Figures 11A, 11B, 11C:
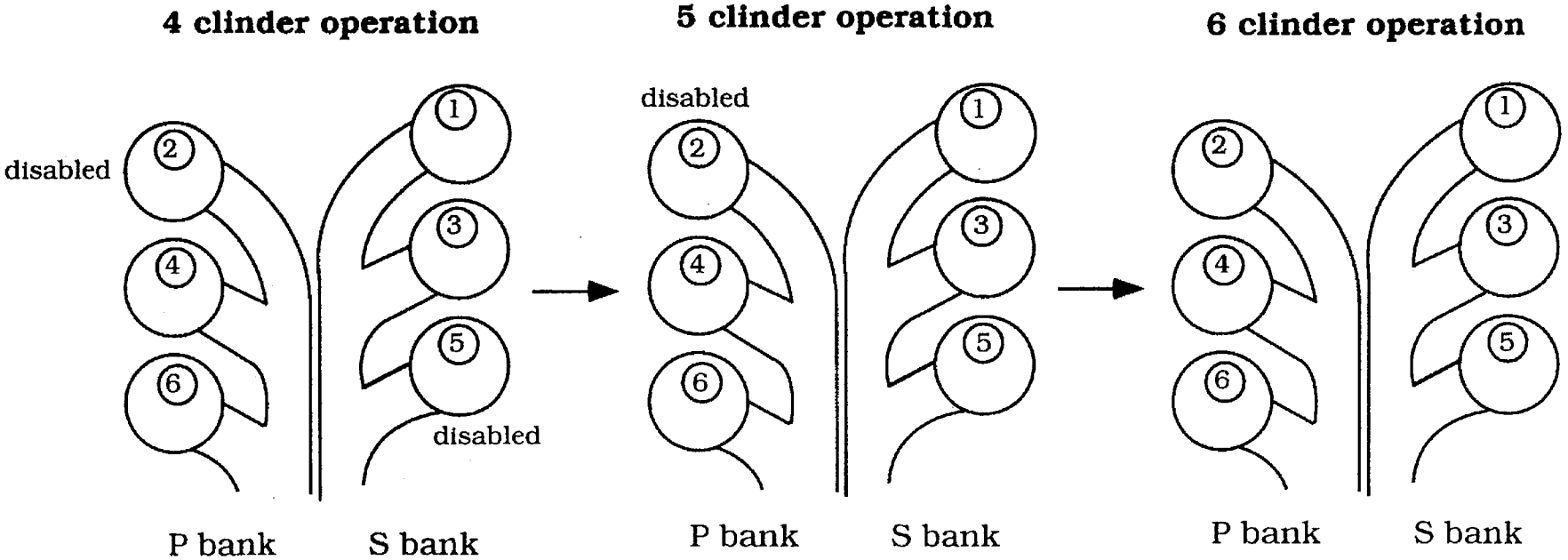
FIGS. 11A, 11B and 11C are schematic illustrations showing an example of switching procedures from the cylinder-disabling mode to the all-cylinders-engaged mode of the first embodiment of the present invention.

(a) While in the cylinder-disabling mode in which four-cylinder in the engine 1 of this embodiment are operated, upper cylinder #2 on the P bank and lower cylinder #5 on the S bank are disabled. In this case, in order to resume the all-cylinder-engaged mode, i.e., six-cylinder operation, first, lower cylinder #5 on the S bank is resumed so as to operate five cylinders (FIGS. 11A and 11B), and then upper cylinder #2 on the P bank is resumed (FIG. 11C).

In the case of an outboard two cycle engine having an exhaust manifold, as clarified earlier with regard to the aspect in which the number of operating cylinders is reduced, when the number of operating cylinders is increased, the fuel injection volume and the ignition timing of the cylinder(s) not only resumed from the disabled state but also operating are changed to a great extent, thereby easily inducing combustion disturbance when the number of operating cylinders is increased. In this embodiment, the number of operating cylinders is increased one by one, so that it is possible to prevent combustion disturbance at least on one side of the banks, thereby facilitating the transition from the cylinder-disabling mode to the all-cylinder-engaged mode.

(b) It is effective to select a cylinder which hardly undergoes intense combustion, in order to facilitate the transition. In the lower cylinders of the engine 1 of this embodiment, since the direction of exhaust pulses from the upper cylinders and the that of exhaust gas flow are the same, the fuel gas volume remaining in the cylinders is high, and thus intense combustion is likely to occur when resuming operation of the cylinders. In this embodiment, when increasing the number of operating cylinders, first, lower cylinder #5 on the S bank which hardly undergoes intense combustion is resumed so as to perform five-cylinder operation, thereby suppressing impact caused by intense combustion when resumed, and facilitating the transition.

When switching from the above five-cylinder operation to six-cylinder operation, upper cylinder #2 on the P bank which easily undergoes intense combustion is resumed. At the time the six-cylinder operation is activated, the engine rpm's are relatively high, and the overall output power of the engine is large, so that even if intense combustion occurs, the influence thereof is not significant.

(c) In addition, in order to facilitate the transition, it is effective to set, for example, a switching point from the five-cylinder operation to the six-cylinder operation, or vice versa, at the engine rpm's and the ignition timing during planing (water-sliding) transition (FIG. 7). During this planing transition, a change in position of a hull is large so that a change in engine rpm's and engine noise due to the change in the number of operating cylinders may not be perceived.

Figure 20:
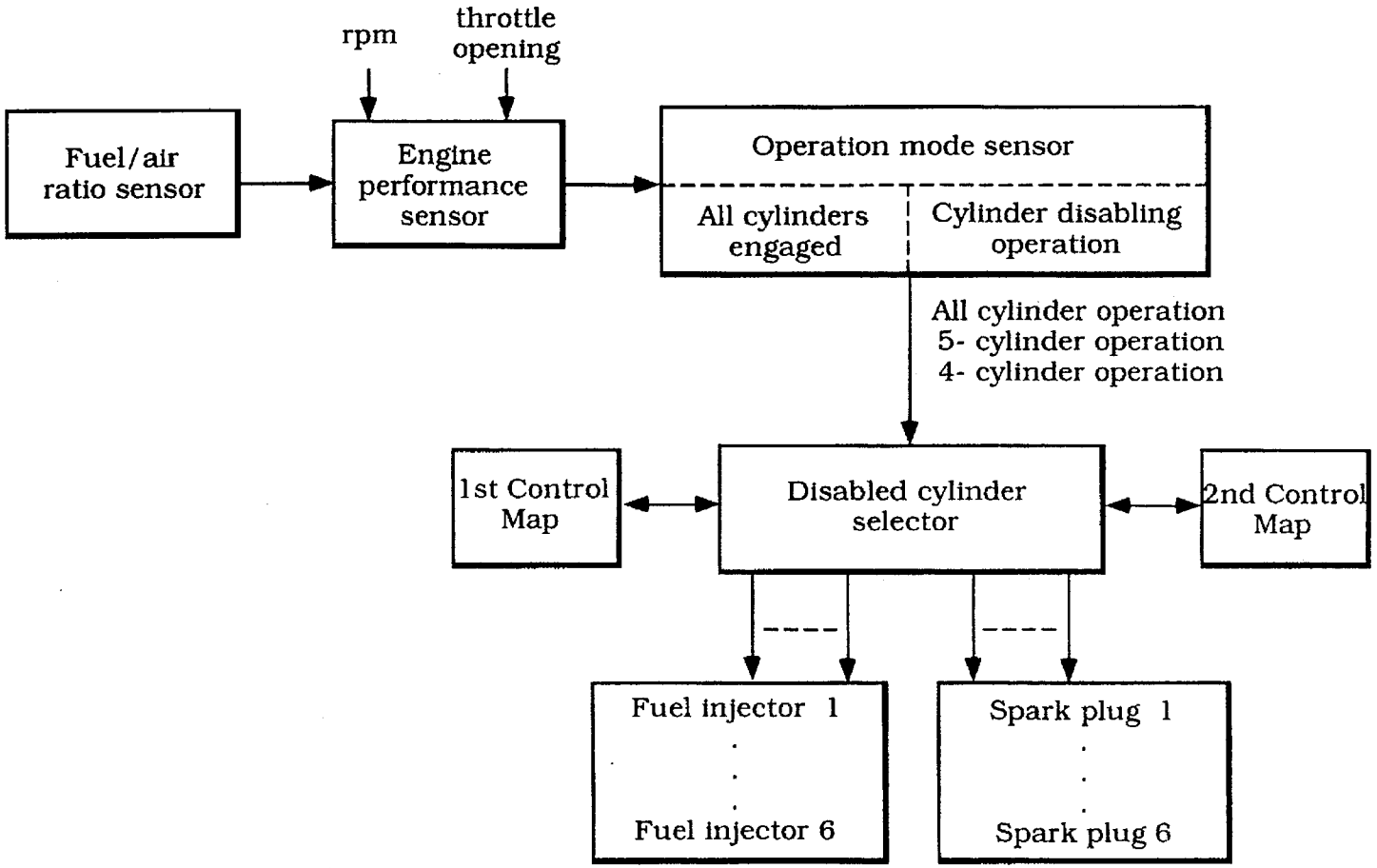
FIG. 20 is a chart showing control flow in an embodiment of the cylinder-disabling control system of the present invention.

The aforesaid disabling control is schematically illustrated in FIG. 20.

As another control flow, it is also effective to control the engine rpm's in the bank, in which the number of operating cylinders is greater than that in the other bank, at a low level while maintaining the same throttle opening. For example, as shown in an enlarged portion of "A" in FIG. 2, when switching from four-cylinder operation to five-cylinder operation at throttle opening $\theta_o$, the engine rpm's are decreased by $\Delta m$.

The reasons for the above are as follows: A factor, which makes us feel that continuous and smooth transition deteriorates when the number of operating cylinders is increased, is an increase in the engine rpm's. When the number of operating cylinders is increased, the number of combustion is increased, and therefore, we tend to feel that the engine rpm's are increased even if the engine rpm's remain the same. Thus, when the number of operating cylinders is increased, the engine rpm's in the bank in which the number of operating cylinders is increased are reduced at approximately a switching point.

VIII. Functions as Fuel Injection Controller When Resuming Operation

Figure 12:
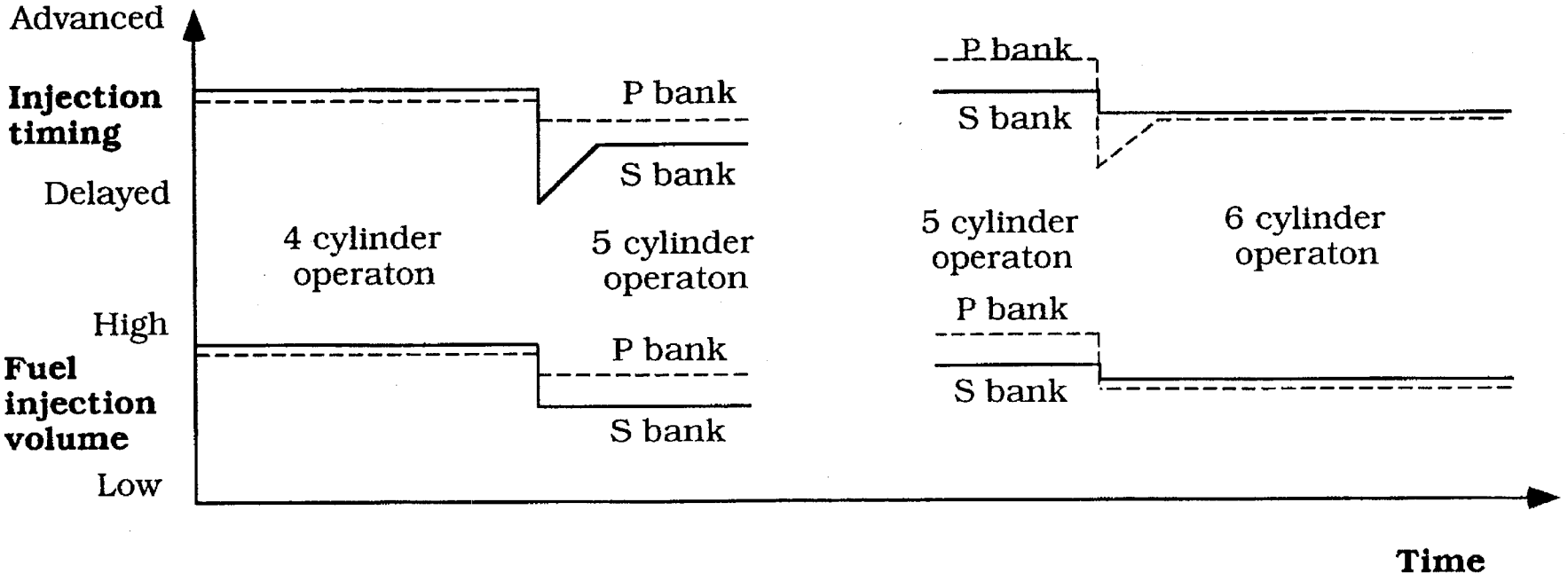
FIG. 12 is a schematic graph showing the relationship of the timing of ignition and the fuel injection volume vs. time-in-transition from four-cylinder operation, five-cylinder operation, and all-cylinder operation of the first embodiment of the present invention.

In relation to an increase in the engine rpm's, six-cylinders operation is resumed from four-cylinder operation via five-cylinder operation. As shown in FIG. 12, when the number of operating cylinders is increased, the fuel injection volume is reduced, and the ignition timing is slowed, thereby mitigating impact when the number of resumed cylinders is increased, and facilitating the transition.

Figure 13:
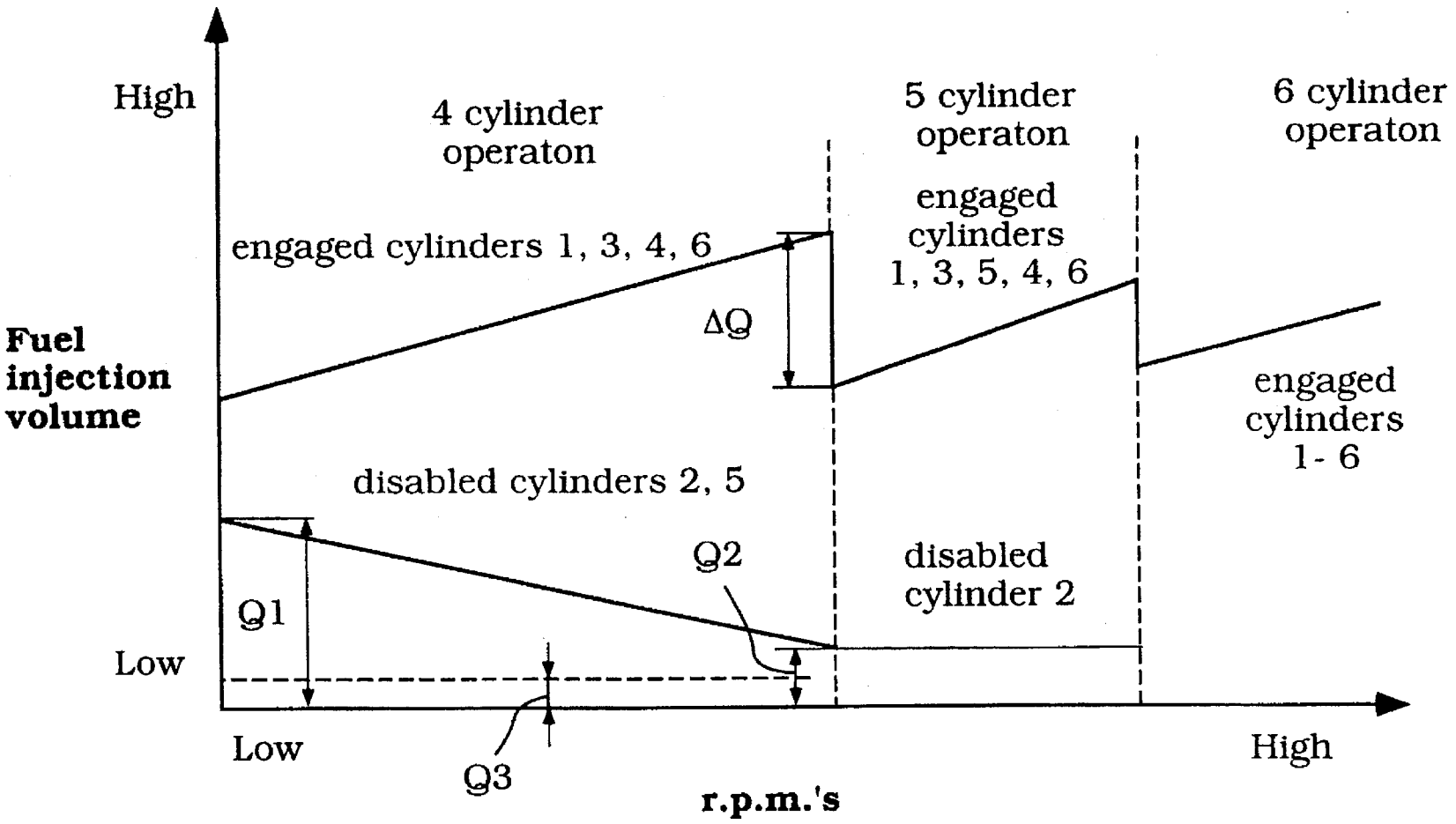
FIG. 13 is a schematic graph showing the relationship between the fuel injection volume and the engine rpm's in transition from four-cylinder operation, five-cylinder operation, and all-cylinder operation of the first embodiment of the present invention.

As shown in FIG. 13, the fuel injection volume per cylinder is increased in relation to an increase in the engine rpm's, and once decreased by $\Delta Q$ when the number of operating cylinders is increased, and then increased in relation to an increase in the engine rpm's again (solid lines in FIG. 13).

The fuel injection volume to lower cylinder #5 on the S bank and upper cylinder #2 on the P bank, which are disabled cylinders while in four-cylinder operation, is controlled in such a way that fuel injection volume $Q_1$ at a low revolution range near idle rpm's is greater than fuel injection volume $Q_2$ in transition towards five-cylinder operation, and fuel injection volume $Q_1$ is gradually reduced towards $Q_2$ in association with an increase in the engine rpm's. In five-cylinder operation, the fuel injection volume is controlled in such a way that the fuel injection volume to upper disabled cylinder #2 is a little increased from $Q_2$ until operation of the cylinder is resumed.

In order to facilitate the transition by mitigating impact or shock when resumed, it is conceivable that the fuel volume to predesignated cylinder #5 to be resumed is preferably set as low as $Q_3$ indicated by a broken line. However, when reducing the fuel volume to such a level, the fuel adhered to the wall of an intake channel becomes very little, and thus, it is very difficult to respond to sharp acceleration because even when the throttle opening urgently opens for sharp acceleration in trolling at low rpm's near idle rpm's, fuel is adhered to the wall first, and the concentration of fuel in the cylinder does not increase. In this embodiment, since the fuel volume at rpm's near trolling rpm's is increased to $Q_1$, and the fuel volume in transition towards five-cylinder operation is decreased to $Q_2$, it is possible to respond to sharp acceleration in trolling, and facilitate the transition by mitigating impact or shock caused by intense combustion in transition towards five-cylinder operation.

Figure 14B:
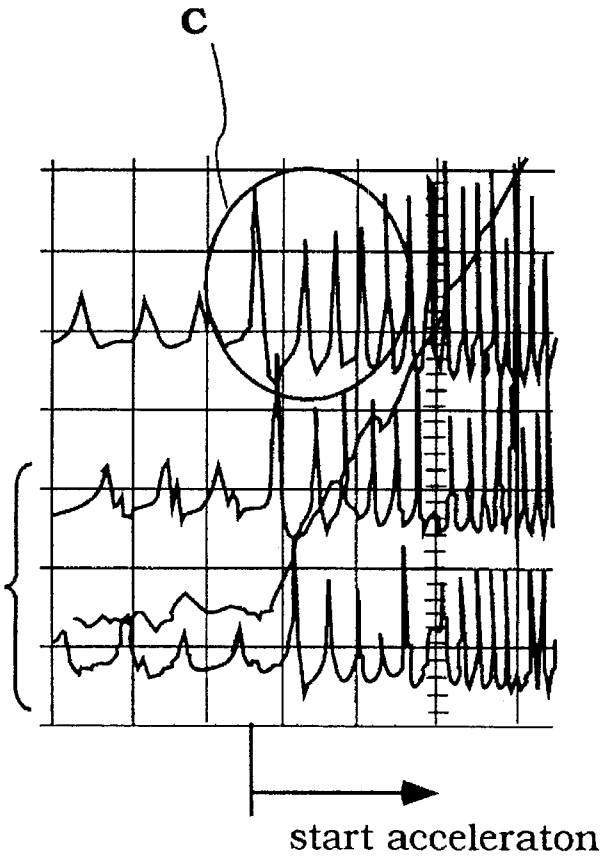
FIGS. 14A and 14B are graphs showing the changes in inside pressure of disabled and operating cylinders when sharply accelerated in the first embodiment of the present invention.
Figure 14A:
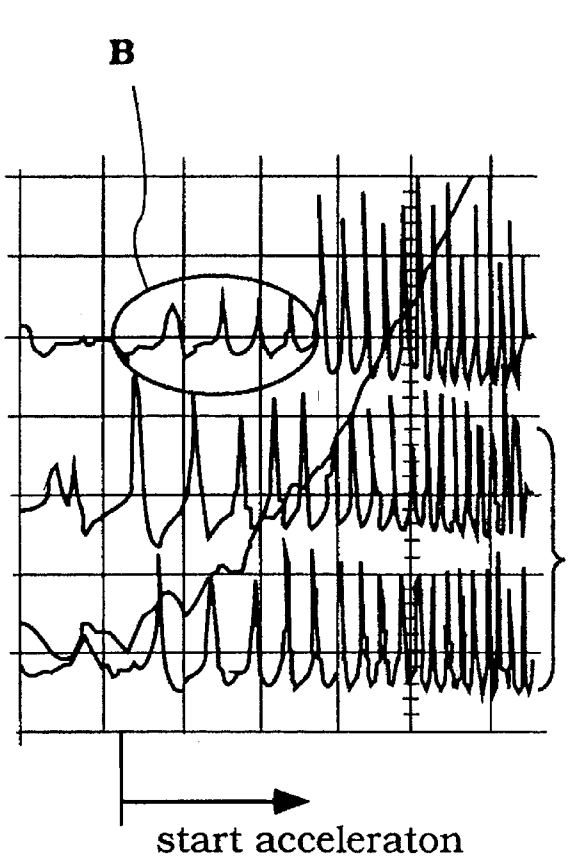

FIG. 14 is graphs obtained by experimentation, showing the changes in inside pressure of disabled and operating cylinders when sharply accelerated. FIG. 14A shows the case in which the fuel volume introduced into the disabled cylinder was as low as $Q_3$, and FIG. 14B shows the embodiment of the present invention in which the fuel volume introduced into the disabled cylinder was initially increased and linearly reduced at a certain rate. When the fuel volume was low, the inside pressure of the cylinder did not go up (circled area B in FIG. 14A), indicating that the cylinder was still disabled. In contrast, in the embodiment of the present invention, the inside pressure in the cylinder was immediately increased, indicating that ignition and combustion were sufficiently performed.

IX. Functions as Ignition Timing Controller When Resuming Operation

Figure 15:
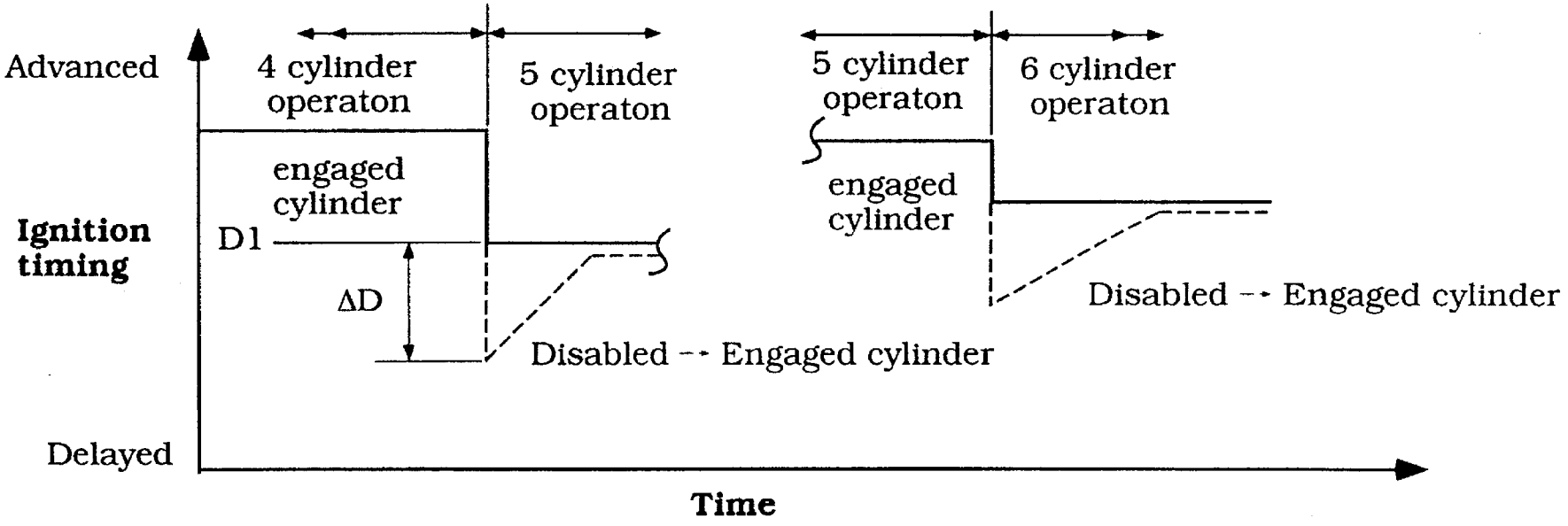
FIG. 15 is a schematic graph showing the relationship of the timing of ignition vs. time-in-transition from four-cylinder operation, five-cylinder operation, and all-cylinder operation of the first embodiment of the present invention.

As shown with a solid line in FIG. 15, in order to facilitate the transition by mitigating impact or shock when resumed, the crank angle for the ignition timing of operating cylinders is set to be delayed, thereby preventing intense combustion; and the crank angle for the ignition timing of resumed cylinders initially starts at an angle for delayed timing equivalent to normal ignition timing $D_1$ minus $\Delta D$ ($D_1$: the ignition timing of operating cylinders), as indicated by a broken line, and the crank angle for the ignition timing gradually goes forwards towards the normal ignition timing. This crank angle control is conducted in the same way, when five-cylinder operation is shifted to six-cylinder operation.

X. Functions as Designator for Designating Constantly-Disabled Cylinders When Resuming Operation from Cylinder-Disabling Mode after Cylinder-Disabling Mode is Released In this embodiment, while in four-cylinder operation, upper cylinder #2 and lower cylinder #5 are constantly disabled, and while in five-cylinder operation, upper cylinder #2 is constantly disabled, thereby stabilizing combustion, and improving fuel efficiency and low speed stability. However, since the same cylinders are constantly disabled, fuel is likely to be adhered to the spark plug in the cylinder, leading to the occurrence of plug foul. In this embodiment, when a main switch is turned on every after the main switch is mined off, and when resuming operation of the disabled cylinders after all-cylinder operation, a cylinder, which is different from the disabled cylinders designated in the previous cycle, is designated as disabled.

For example, when four cylinders are in operation, upper cylinder #2 and lower cylinder #5 are disabled, and then upper cylinder #1 and lower cylinder #6 are disabled. When five cylinders are in operation, upper cylinder #2 is disabled, and then upper cylinder #1 is disabled. Accordingly, the fuel adhered to the spark plug while being disabled is burned off, thereby preventing plug foul in the cylinder.

Other Embodiments

In this embodiment, in cylinder disabling pattern No. 1 and No. 2 described earlier, upper cylinders or lower cylinders are constantly designated as disabled. However, other patterns can be adopted. FIGS. 16 and 17 are schematic graphs showing the relationship between the fuel injection volume and the engine rpm's with a parameter of cylinders (FIG. 16) and the relationship between the ignition timing and the engine rpm's with a parameter of cylinders (FIG. 17) in a second embodiment. In this embodiment, in disabled cylinders, fuel is continuously introduced while ignition is conducted at intervals.

Figures 16A, 16B:
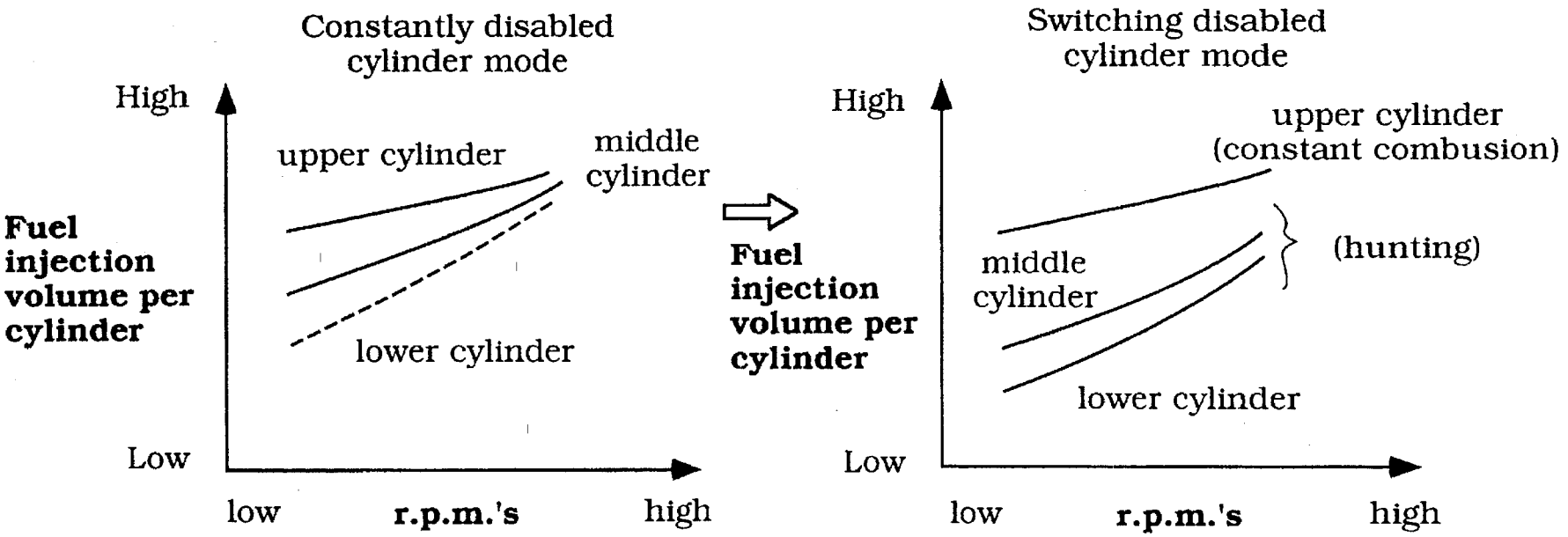
FIGS. 16A and 16B are schematic graphs showing the relationship between the fuel injection volume and the engine rpm's with a parameter of cylinders in the constantly-disabled-cylinder mode (FIG. 16A) and the switching-disabled-cylinder mode (FIG. 16B) of a second embodiment of the present invention.
Figures 17A, 17B:
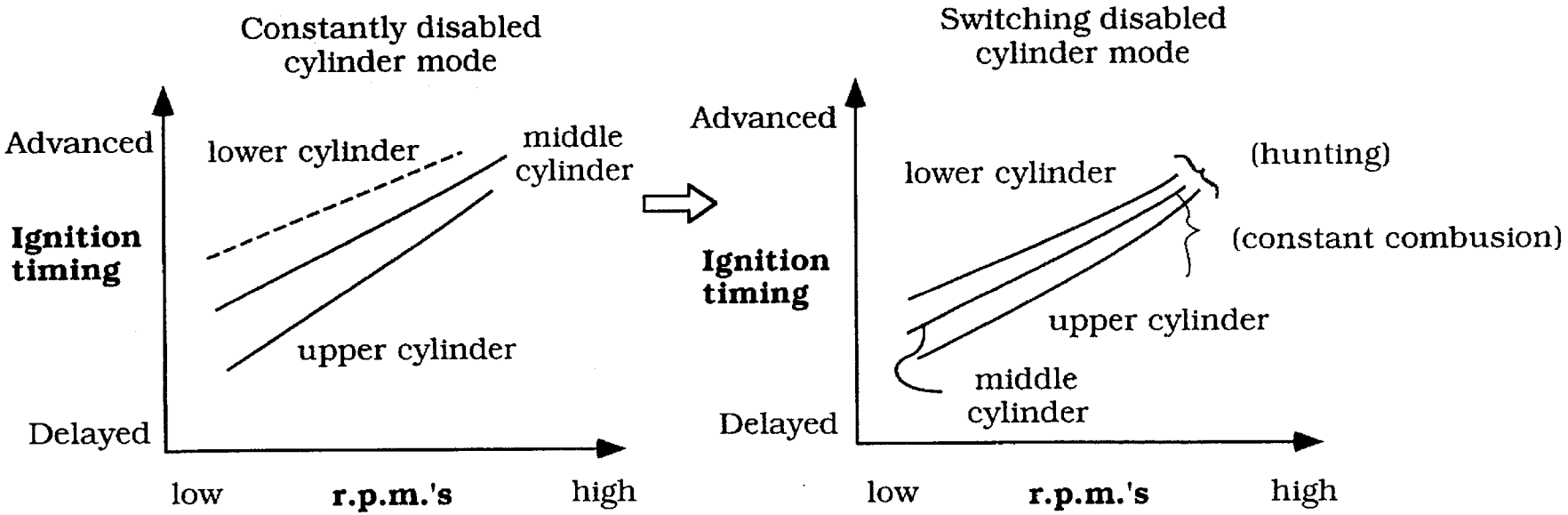
FIGS. 17A and 17B are schematic graphs showing the relationship between the timing of ignition and the engine rpm's with a parameter of cylinders in the constantly-disabled-cylinder mode (FIG. 17A) and the switching-disabled-cylinder mode (FIG. 17B) of a second embodiment of the present invention.

When the lower and middle cylinders are disabled alternately (FIG. 16B), the fuel injection volume in the constantly operating upper cylinder barely fluctuates while that in the middle and lower cylinders is significantly reduced, as compared with the case in which the lower cylinder is constantly disabled (FIG. 16A). Accordingly, for example, while the middle cylinder is in operation, the injected fuel remains in the intake channel of the lower cylinder, and thus, the fuel injection volume in the lower cylinder in the next cycle is significantly reduced.

With regard to the ignition timing, in the switching-disabled-cylinder mode (FIG. 17B), the ignition timing of the constantly operating upper cylinder is not substantially changed while the ignition timing of the middle and lower cylinders is delayed as a whole. Accordingly, although the middle and lower cylinders are ignited in each cycle so as to fully scavenge the gas in the cylinders, thereby increasing the fuel injection efficiency and the combustion intensity, it is possible to prevent the occurrence of imbalance of combustion intensity between the upper cylinder and the middle and lower cylinders.

Figure 18A:
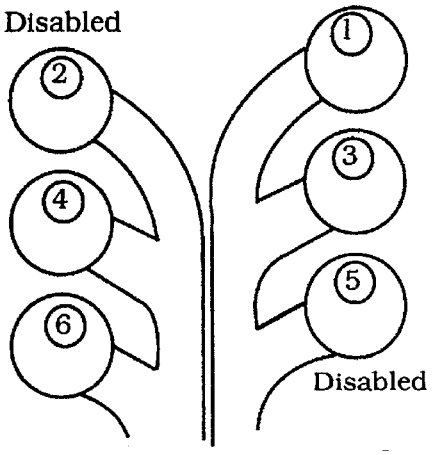
FIGS. 18A and 18B are schematic illustrations showing switching procedures from four-cylinder operation (FIG. 18A) to all-cylinders-operation (FIG. 18B) of a modified second embodiment of the present invention.
Figure 18B:
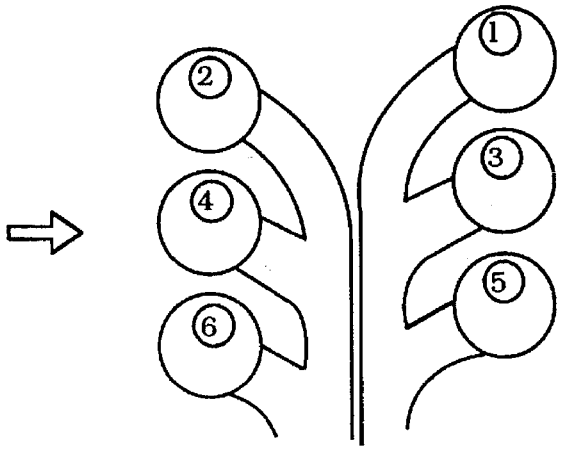
Figure 19:
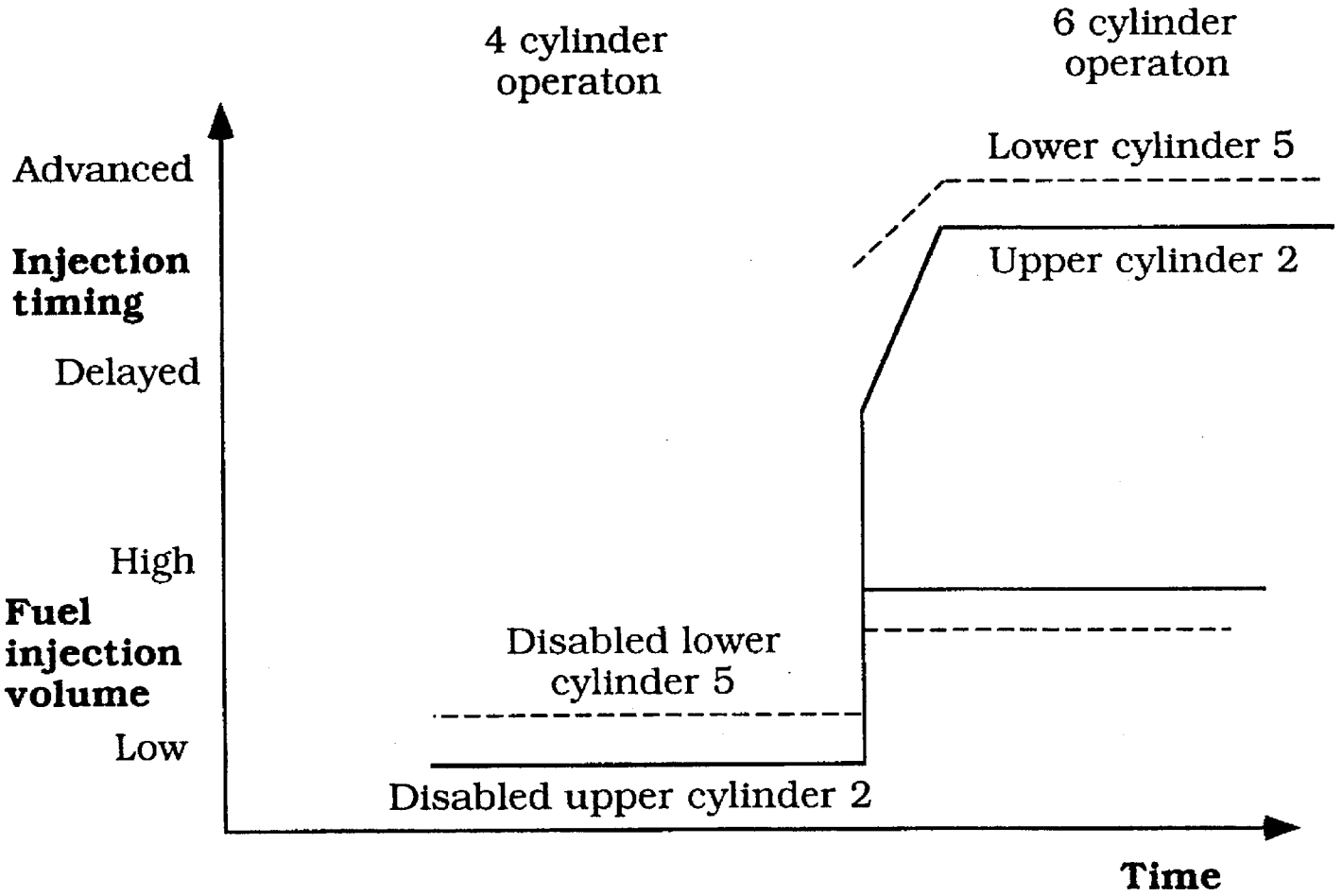
FIG. 19 is a schematic graph showing the relationship of the timing of ignition and the fuel injection volume vs. time-in-transition from four-cylinder operation to all-cylinder operation of the modified second embodiment of the present invention.

Embodiments other than the above embodiment, which is directed to the case in which four-cylinder operation is switched to six-cylinder operation via five-cylinder, is also operable. In FIG. 18 in which four-cylinder operation (upper cylinder #2 and lower cylinder #5 are disabled) is switched to six-cylinder operation (upper cylinder #2 and lower cylinder #5 are simultaneously resumed), timing control to delay the ignition timing is effective in mitigating impact or shock when resumed as shown in FIG. 19. In this case, it is preferred to reduce, as compared with in lower cylinder #5, the fuel injection volume in upper cylinder #2 that is likely to undergo intense combustion, or to set the igniting timing to be further delayed.

In addition to applying this principle to a two-cycle engine, it should be readily apparent that the same principle can be applied to four-cycle engines, although the invention has particular utility with two-cycle engines. Various other changes and modifications may be made without departing from the spirit and scope of the invention, as defined by the appended claims.

I claim:

1. A cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a disabled-cylinder designator for designating as disabled at least one of: the most upstream cylinder, which is a cylinder located most upstream in the direction of exhaust gas flow, and the exhaust pulse-affected downstream cylinder, which is a cylinder receiving exhaust pulse from said most upstream cylinder, when the cylinder-disabling mode is selected.

2. A cylinder-disabling control system according to claim 1, further comprises a fuel/air ratio detecting means for detecting the fuel/air ratio in the operating cylinder(s) while in the cylinder-disabling mode.

3. A cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a fuel/air ratio detecting means for detecting the fuel/air ration in the operating cylinder(s) while in the cylinder-disabling mode.

4. A cylinder-disabling control system for a multi-cylinder engine provided with an exhaust manifold to which each exhaust port is connected, said control system comprising: an engine performance sensor for sensing the engine performance; an operation mode selector for selecting either a cylinder-disabling mode in which at least one but not all of the cylinders are disabled, or an all-cylinders-engaged mode in which all of the cylinders are operated, depending on the engine performance; and a controller for controlling the fuel injection volume and the ignition timing in the cylinders, said controller including a first control map for setting the fuel injection volume and the ignition timing for each cylinder in the all-cylinder-engaged mode, and a second control map for setting the fuel injection volume and the ignition timing for each cylinder when the cylinder-disabling mode is selected.

5. A cylinder-disabling control system according to claim 4, wherein said second control map is comprised of plural maps corresponding to plural disabling patterns, each map for setting the fuel injection volume and the ignition timing corresponding to each disabling pattern defined by the location of the disabled cylinder(s).

6. A cylinder-disabling control system according to claim 4, wherein said second control map is comprised of a constant mode map used when the same cylinder is constantly designated as disabled, and a changing-mode map used when different cylinders are designated as disabled.

7. A cylinder-disabling control system according to claim 6, wherein said changing-mode map sets the fuel injection volume lower than that set by said constant mode map, and sets the ignition timing later than that set by said constant mode map.

8. A method for cylinder-disabling control for a multi-cylinder engine provided with an exhaust manifold to which each exhaust port is connected, said method comprising the steps of: sensing the engine performance; selecting either a cylinder-disabling mode in which at least one but not all of the cylinders are disabled, or an all-cylinders-engaged mode in which all of the cylinders are operated, depending on the engine performance; and detecting the fuel/air ration in the operating cylinder(s) while in the cylinder-disabling mode.

9. A method for cylinder-disabling control for a multi-cylinder engine provided with an exhaust manifold to which each exhaust port is connected, said method comprising the steps of: sensing the engine performance; selecting either a cylinder-disabling mode in which at least one but not all of the cylinders are disabled, or an all-cylinders-engaged mode in which all of the cylinders are operated, depending on the engine performance; and designating as disabled at least one of the most upstream cylinder, which is a cylinder located most upstream in the direction of exhaust gas flow, and the exhaust pulse-affected downstream cylinder, which is a cylinder receiving exhaust pulse from said most upstream cylinder, when the cylinder-disabling mode is selected.

10. A method according to claim 9, further comprises the step of detecting the fuel/air ration in the operating cylinder (s) while in the cylinder-disabling mode.

11. A method for cylinder-disabling control for a multi-cylinder engine provided with an exhaust manifold to which each exhaust port is connected, said method comprising the steps of: sensing the engine performance; selecting either a cylinder-disabling mode in which at least one but not all of the cylinders are disabled, or an all-cylinders-engaged mode in which all of the cylinders are operated, depending on the engine performance; and controlling the fuel injection volume and the ignition timing in the cylinders, based on a first control map for setting the fuel injection volume and the ignition timing for each cylinder in the all-cylinder-engaged mode, and a second control map for setting the fuel injection volume and the ignition timing for each cylinder when the cylinder-disabling mode is selected.

12. A method according to claim 11, wherein said second control map is comprised of plural maps corresponding to plural disabling patterns, each map for setting the fuel injection volume and the ignition timing corresponding to each disabling pattern defined by the location of the disabled cylinder(s).

13. A method according to claim 11, wherein said second control map is comprised of a constant mode map used when the same cylinder is constantly designated as disabled, and a changing-mode map used when a different cylinder is designated as disabled.

14. A method according to claim 13, wherein said changing-mode map sets the fuel injection volume lower than that set by said constant mode map, and sets the ignition timing later than that set by said constant mode map.

* * * * *